US007903129B2

(12) United States Patent
Inoue

(10) Patent No.: US 7,903,129 B2
(45) Date of Patent: Mar. 8, 2011

(54) IMAGE DISPLAY DEVICE

(75) Inventor: Akihiko Inoue, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 134 days.

(21) Appl. No.: 12/309,977

(22) PCT Filed: Jun. 15, 2007

(86) PCT No.: PCT/JP2007/062088

§ 371 (c)(1),
(2), (4) Date: Feb. 5, 2009

(87) PCT Pub. No.: WO2008/062577

PCT Pub. Date: May 29, 2008

(65) Prior Publication Data

US 2009/0322720 A1 Dec. 31, 2009

(30) Foreign Application Priority Data

Nov. 24, 2006 (JP) ..... 2006-317057

(51) Int. Cl.
*G09G 5/10* (2006.01)

(52) U.S. Cl. ..... 345/690; 345/208

(58) Field of Classification Search ..... 345/690, 345/208, 87, 89, 94
See application file for complete search history.

(56) References Cited

U.S. PATENT DOCUMENTS

| | | | |
|---|---|---|---|
| 2005/0162360 | A1 | 7/2005 | Ishihara et al. |
| 2005/0253785 | A1 | 11/2005 | Miyasaka et al. |

FOREIGN PATENT DOCUMENTS

| | | |
|---|---|---|
| JP | 2650479 | 7/1991 |
| JP | 9-325715 | 12/1997 |
| JP | 2001-042831 | 2/2001 |
| JP | 2005-091454 | 4/2005 |
| JP | 2005-173387 | 6/2005 |
| JP | 2005-173573 | 6/2005 |

*Primary Examiner* — Ricardo L Osorio

(74) *Attorney, Agent, or Firm* — Harness, Dickey & Pierce, P.L.C.

(57) ABSTRACT

A simple double-speed process circuit 60 outputs a video signal V1 twice at a double speed in units of frames. A time-division gradation process circuit 50 performs gradation level conversion on the video signal in order to distribute brightness for one frame cycle to two sub-frame cycles, i.e. first and second sub-frame cycles. An overshoot process circuit 40 performs gradation level conversion on the video signal in order to-emphasize a temporal change of the signal. A drive circuit 20 drives liquid crystal display elements 31 using a video signal V2 obtained through processing by the three circuits. A frame interpolation process circuit may be added to this circuit configuration or may be substituted for the simple double-speed process circuit 60. This makes it possible to improve moving image display performance, while making up for a lack of response speed of the display elements.

12 Claims, 23 Drawing Sheets

*Fig. 4*

DISPLAY POSITION (PIXEL)

| | | | | | | | | | | | | | | |
|---|---|---|---|---|---|---|---|---|---|---|---|---|---|---|
| 158 | 158 | 158 | 158 | 0 | 0 | 0 | 0 | 0 | 0 | 0 | 0 | 0 | 0 | 0 |
| 158 | 158 | 158 | 158 | 158 | 158 | 0 | 0 | 0 | 0 | 0 | 0 | 0 | 0 | 0 |
| 158 | 158 | 158 | 158 | 158 | 158 | 158 | 158 | 0 | 0 | 0 | 0 | 0 | 0 | 0 |
| 158 | 158 | 158 | 158 | 158 | 158 | 158 | 158 | 158 | 158 | 0 | 0 | 0 | 0 | 0 |
| 158 | 158 | 158 | 158 | 158 | 158 | 158 | 158 | 158 | 158 | 158 | 158 | 0 | 0 | 0 |
| 158 | 158 | 158 | 158 | 158 | 158 | 158 | 158 | 158 | 158 | 158 | 158 | 158 | 158 | 0 |

ONE FRAME CYCLE

TIME

PIXEL OF INTEREST

*Fig. 5*

DISPLAY POSITION (PIXEL)

| | | | | | | | | | | | | | | |
|---|---|---|---|---|---|---|---|---|---|---|---|---|---|---|
| 158 | 158 | 158 | 158 | 0 | 0 | 0 | 0 | 0 | 0 | 0 | 0 | 0 | 0 | 0 |
| 158 | 158 | 158 | 158 | 0 | 0 | 0 | 0 | 0 | 0 | 0 | 0 | 0 | 0 | 0 |
| 158 | 158 | 158 | 158 | 158 | 158 | 0 | 0 | 0 | 0 | 0 | 0 | 0 | 0 | 0 |
| 158 | 158 | 158 | 158 | 158 | 158 | 0 | 0 | 0 | 0 | 0 | 0 | 0 | 0 | 0 |
| 158 | 158 | 158 | 158 | 158 | 158 | 158 | 158 | 0 | 0 | 0 | 0 | 0 | 0 | 0 |
| 158 | 158 | 158 | 158 | 158 | 158 | 158 | 158 | 0 | 0 | 0 | 0 | 0 | 0 | 0 |
| 158 | 158 | 158 | 158 | 158 | 158 | 158 | 158 | 158 | 158 | 0 | 0 | 0 | 0 | 0 |
| 158 | 158 | 158 | 158 | 158 | 158 | 158 | 158 | 158 | 158 | 0 | 0 | 0 | 0 | 0 |
| 158 | 158 | 158 | 158 | 158 | 158 | 158 | 158 | 158 | 158 | 158 | 158 | 0 | 0 | 0 |
| 158 | 158 | 158 | 158 | 158 | 158 | 158 | 158 | 158 | 158 | 158 | 158 | 0 | 0 | 0 |
| 158 | 158 | 158 | 158 | 158 | 158 | 158 | 158 | 158 | 158 | 158 | 158 | 158 | 158 | 0 |
| 158 | 158 | 158 | 158 | 158 | 158 | 158 | 158 | 158 | 158 | 158 | 158 | 158 | 158 | 0 |

NEW ONE FRAME CYCLE

TIME

PIXEL OF INTEREST

*Fig. 6*

DISPLY POSITION(PIXEL)

| | | | | | | | | | | | | | | | |
|---|---|---|---|---|---|---|---|---|---|---|---|---|---|---|---|
| 8 | 8 | 8 | 8 | 0 | 0 | 0 | 0 | 0 | 0 | 0 | 0 | 0 | 0 | 0 | FIRST |
| 238 | 238 | 238 | 238 | 0 | 0 | 0 | 0 | 0 | 0 | 0 | 0 | 0 | 0 | 0 | SECOND |
| 8 | 8 | 8 | 8 | 8 | 8 | 0 | 0 | 0 | 0 | 0 | 0 | 0 | 0 | 0 | ONE SUB-FRAME CYCLE |
| 238 | 238 | 238 | 238 | 238 | 238 | 0 | 0 | 0 | 0 | 0 | 0 | 0 | 0 | 0 | |
| 8 | 8 | 8 | 8 | 8 | 8 | 8 | 8 | 0 | 0 | 0 | 0 | 0 | 0 | 0 | |
| 238 | 238 | 238 | 238 | 238 | 238 | 238 | 238 | 0 | 0 | 0 | 0 | 0 | 0 | 0 | |
| 8 | 8 | 8 | 8 | 8 | 8 | 8 | 8 | 8 | 8 | 0 | 0 | 0 | 0 | 0 | |
| 238 | 238 | 238 | 238 | 238 | 238 | 238 | 238 | 238 | 238 | 0 | 0 | 0 | 0 | 0 | |
| 8 | 8 | 8 | 8 | 8 | 8 | 8 | 8 | 8 | 8 | 8 | 8 | 0 | 0 | 0 | |
| 238 | 238 | 238 | 238 | 238 | 238 | 238 | 238 | 238 | 238 | 238 | 238 | 0 | 0 | 0 | |
| 8 | 8 | 8 | 8 | 8 | 8 | 8 | 8 | 8 | 8 | 8 | 8 | 8 | 8 | 0 | |
| 238 | 238 | 238 | 238 | 238 | 238 | 238 | 238 | 238 | 238 | 238 | 238 | 238 | 238 | 0 | |

TIME

PIXEL OF INTEREST

*Fig. 7*

DISPLAY POSITION(PIXEL)

| | | | | | | | | | | | | | | | |
|---|---|---|---|---|---|---|---|---|---|---|---|---|---|---|---|
| 4 | 4 | 9 | 9 | 0 | 0 | 0 | 0 | 0 | 0 | 0 | 0 | 0 | 0 | 0 | FIRST |
| 247 | 247 | 247 | 247 | 0 | 0 | 0 | 0 | 0 | 0 | 0 | 0 | 0 | 0 | 0 | SECOND |
| 4 | 4 | 4 | 4 | 9 | 9 | 0 | 0 | 0 | 0 | 0 | 0 | 0 | 0 | 0 | ONE SUB-FRAME CYCLE |
| 247 | 247 | 247 | 247 | 247 | 247 | 0 | 0 | 0 | 0 | 0 | 0 | 0 | 0 | 0 | |
| 4 | 4 | 4 | 4 | 4 | 4 | 9 | 9 | 0 | 0 | 0 | 0 | 0 | 0 | 0 | |
| 247 | 247 | 247 | 247 | 247 | 247 | 247 | 247 | 0 | 0 | 0 | 0 | 0 | 0 | 0 | |
| 4 | 4 | 4 | 4 | 4 | 4 | 4 | 4 | 9 | 9 | 0 | 0 | 0 | 0 | 0 | |
| 247 | 247 | 247 | 247 | 247 | 247 | 247 | 247 | 247 | 247 | 0 | 0 | 0 | 0 | 0 | |
| 4 | 4 | 4 | 4 | 4 | 4 | 4 | 4 | 4 | 4 | 9 | 9 | 0 | 0 | 0 | |
| 247 | 247 | 247 | 247 | 247 | 247 | 247 | 247 | 247 | 247 | 247 | 247 | 0 | 0 | 0 | |
| 4 | 4 | 4 | 4 | 4 | 4 | 4 | 4 | 4 | 4 | 4 | 4 | 9 | 9 | 0 | |
| 247 | 247 | 247 | 247 | 247 | 247 | 247 | 247 | 247 | 247 | 247 | 247 | 247 | 247 | 0 | |

TIME

PIXEL OF INTEREST

*Fig. 20*

DISPLAY POSITION (PIXEL)

| | | | | | | | | | | | | | | |
|---|---|---|---|---|---|---|---|---|---|---|---|---|---|---|
| 158 | 158 | 158 | 158 | 0 | 0 | 0 | 0 | 0 | 0 | 0 | 0 | 0 | 0 | 0 |
| 158 | 158 | 158 | 158 | 158 | 158 | 0 | 0 | 0 | 0 | 0 | 0 | 0 | 0 | 0 |
| 158 | 158 | 158 | 158 | 158 | 158 | 158 | 158 | 0 | 0 | 0 | 0 | 0 | 0 | 0 |
| 158 | 158 | 158 | 158 | 158 | 158 | 158 | 158 | 158 | 158 | 0 | 0 | 0 | 0 | 0 |
| 158 | 158 | 158 | 158 | 158 | 158 | 158 | 158 | 158 | 158 | 158 | 158 | 0 | 0 | 0 |
| 158 | 158 | 158 | 158 | 158 | 158 | 158 | 158 | 158 | 158 | 158 | 158 | 158 | 158 | 0 |

ONE FRAME CYCLE

TIME

PIXEL OF INTEREST

*Fig. 21*

DISPLAY POSITION (PIXEL)

| | | | | | | | | | | | | | | |
|---|---|---|---|---|---|---|---|---|---|---|---|---|---|---|
| 158 | 158 | 158 | 158 | 0 | 0 | 0 | 0 | 0 | 0 | 0 | 0 | 0 | 0 | 0 |
| 158 | 158 | 158 | 158 | 158 | 0 | 0 | 0 | 0 | 0 | 0 | 0 | 0 | 0 | 0 |
| 158 | 158 | 158 | 158 | 158 | 158 | 0 | 0 | 0 | 0 | 0 | 0 | 0 | 0 | 0 |
| 158 | 158 | 158 | 158 | 158 | 158 | 158 | 0 | 0 | 0 | 0 | 0 | 0 | 0 | 0 |
| 158 | 158 | 158 | 158 | 158 | 158 | 158 | 158 | 0 | 0 | 0 | 0 | 0 | 0 | 0 |
| 158 | 158 | 158 | 158 | 158 | 158 | 158 | 158 | 158 | 0 | 0 | 0 | 0 | 0 | 0 |
| 158 | 158 | 158 | 158 | 158 | 158 | 158 | 158 | 158 | 158 | 0 | 0 | 0 | 0 | 0 |
| 158 | 158 | 158 | 158 | 158 | 158 | 158 | 158 | 158 | 158 | 158 | 0 | 0 | 0 | 0 |
| 158 | 158 | 158 | 158 | 158 | 158 | 158 | 158 | 158 | 158 | 158 | 158 | 0 | 0 | 0 |
| 158 | 158 | 158 | 158 | 158 | 158 | 158 | 158 | 158 | 158 | 158 | 158 | 158 | 0 | 0 |
| 158 | 158 | 158 | 158 | 158 | 158 | 158 | 158 | 158 | 158 | 158 | 158 | 158 | 158 | 0 |
| 158 | 158 | 158 | 158 | 158 | 158 | 158 | 158 | 158 | 158 | 158 | 158 | 158 | 158 | 158 |

NEW ONE FRAME CYCLE

TIME

PIXEL OF INTEREST

*Fig. 22*

DISPLAY POSITION(PIXEL)

| | | | | | | | | | | | | | | | |
|---|---|---|---|---|---|---|---|---|---|---|---|---|---|---|---|
| 8 | 8 | 8 | 8 | 0 | 0 | 0 | 0 | 0 | 0 | 0 | 0 | 0 | 0 | 0 | FIRST |
| 238 | 238 | 238 | 238 | 238 | 0 | 0 | 0 | 0 | 0 | 0 | 0 | 0 | 0 | 0 | SECOND |
| 8 | 8 | 8 | 8 | 8 | 8 | 0 | 0 | 0 | 0 | 0 | 0 | 0 | 0 | 0 | ONE SUB-FRAME CYCLE |
| 238 | 238 | 238 | 238 | 238 | 238 | 238 | 0 | 0 | 0 | 0 | 0 | 0 | 0 | 0 | |
| 8 | 8 | 8 | 8 | 8 | 8 | 8 | 8 | 0 | 0 | 0 | 0 | 0 | 0 | 0 | |
| 238 | 238 | 238 | 238 | 238 | 238 | 238 | 238 | 238 | 0 | 0 | 0 | 0 | 0 | 0 | |
| 8 | 8 | 8 | 8 | 8 | 8 | 8 | 8 | 8 | 8 | 0 | 0 | 0 | 0 | 0 | |
| 238 | 238 | 238 | 238 | 238 | 238 | 238 | 238 | 238 | 238 | 238 | 0 | 0 | 0 | 0 | |
| 8 | 8 | 8 | 8 | 8 | 8 | 8 | 8 | 8 | 8 | 8 | 8 | 0 | 0 | 0 | |
| 238 | 238 | 238 | 238 | 238 | 238 | 238 | 238 | 238 | 238 | 238 | 238 | 238 | 0 | 0 | |
| 8 | 8 | 8 | 8 | 8 | 8 | 8 | 8 | 8 | 8 | 8 | 8 | 8 | 8 | 0 | |
| 238 | 238 | 238 | 238 | 238 | 238 | 238 | 238 | 238 | 238 | 238 | 238 | 238 | 238 | 238 | |

TIME

PIXEL OF INTEREST

*Fig. 23*

DISPLAY POSITION(PIXEL)

| | | | | | | | | | | | | | | | |
|---|---|---|---|---|---|---|---|---|---|---|---|---|---|---|---|
| 4 | 4 | 4 | 9 | 0 | 0 | 0 | 0 | 0 | 0 | 0 | 0 | 0 | 0 | 0 | FIRST |
| 247 | 247 | 247 | 247 | 255 | 0 | 0 | 0 | 0 | 0 | 0 | 0 | 0 | 0 | 0 | SECOND |
| 4 | 4 | 4 | 4 | 4 | 9 | 0 | 0 | 0 | 0 | 0 | 0 | 0 | 0 | 0 | ONE SUB-FRAME CYCLE |
| 247 | 247 | 247 | 247 | 247 | 247 | 255 | 0 | 0 | 0 | 0 | 0 | 0 | 0 | 0 | |
| 4 | 4 | 4 | 4 | 4 | 4 | 4 | 9 | 0 | 0 | 0 | 0 | 0 | 0 | 0 | |
| 247 | 247 | 247 | 247 | 247 | 247 | 247 | 247 | 255 | 0 | 0 | 0 | 0 | 0 | 0 | |
| 4 | 4 | 4 | 4 | 4 | 4 | 4 | 4 | 4 | 9 | 0 | 0 | 0 | 0 | 0 | |
| 247 | 247 | 247 | 247 | 247 | 247 | 247 | 247 | 247 | 247 | 255 | 0 | 0 | 0 | 0 | |
| 4 | 4 | 4 | 4 | 4 | 4 | 4 | 4 | 4 | 4 | 4 | 9 | 0 | 0 | 0 | |
| 247 | 247 | 247 | 247 | 247 | 247 | 247 | 247 | 247 | 247 | 247 | 247 | 255 | 0 | 0 | |
| 4 | 4 | 4 | 4 | 4 | 4 | 4 | 4 | 4 | 4 | 4 | 4 | 4 | 9 | 0 | |
| 247 | 247 | 247 | 247 | 247 | 247 | 247 | 247 | 247 | 247 | 247 | 247 | 247 | 247 | 255 | |

TIME

PIXEL OF INTEREST

*Fig. 27*

DISPLAY POSITION (PIXEL)

| | | | | | | | | | | | | | | | |
|---|---|---|---|---|---|---|---|---|---|---|---|---|---|---|---|
| 0 | 0 | 0 | 0 | 0 | 0 | 0 | 0 | 0 | 0 | 0 | 0 | 0 | 0 | 0 | FIRST |
| 255 | 255 | 255 | 255 | 0 | 0 | 0 | 0 | 0 | 0 | 0 | 0 | 0 | 0 | 0 | SECOND |
| 0 | 0 | 0 | 0 | 0 | 0 | 0 | 0 | 0 | 0 | 0 | 0 | 0 | 0 | 0 | ONE SUB-FRAME CYCLE |
| 255 | 255 | 255 | 255 | 255 | 255 | 0 | 0 | 0 | 0 | 0 | 0 | 0 | 0 | 0 | |
| 0 | 0 | 0 | 0 | 0 | 0 | 0 | 0 | 0 | 0 | 0 | 0 | 0 | 0 | 0 | |
| 255 | 255 | 255 | 255 | 255 | 255 | 255 | 255 | 0 | 0 | 0 | 0 | 0 | 0 | 0 | |
| 0 | 0 | 0 | 0 | 0 | 0 | 0 | 0 | 0 | 0 | 0 | 0 | 0 | 0 | 0 | |
| 255 | 255 | 255 | 255 | 255 | 255 | 255 | 255 | 255 | 255 | 0 | 0 | 0 | 0 | 0 | |
| 0 | 0 | 0 | 0 | 0 | 0 | 0 | 0 | 0 | 0 | 0 | 0 | 0 | 0 | 0 | |
| 255 | 255 | 255 | 255 | 255 | 255 | 255 | 255 | 255 | 255 | 255 | 255 | 0 | 0 | 0 | |
| 0 | 0 | 0 | 0 | 0 | 0 | 0 | 0 | 0 | 0 | 0 | 0 | 0 | 0 | 0 | |
| 255 | 255 | 255 | 255 | 255 | 255 | 255 | 255 | 255 | 255 | 255 | 255 | 255 | 255 | 0 | |

TIME

PIXEL OF INTEREST

IMAGE DISPLAY DEVICE

TECHNICAL FIELD

The present invention relates to image display devices, such as liquid crystal display devices and electroluminescence display devices.

BACKGROUND ART

Image display devices, such as liquid crystal display devices, are disadvantageous in that, when displaying a moving image, boundaries with different display brightness are visually perceived as blurry. Such a deterioration in moving image display performance is due to the following two factors. The first factor is that display elements have a response speed slower than a speed corresponding to one frame cycle of video. A known technology for making up for such a lack of response speed of the display elements is overshoot drive (also referred to as "overdrive"). Overshoot drive is a method for forcibly driving display elements at high speed by applying voltage higher or lower than voltage for achieving a desired gradation level, in accordance with the direction in which the gradation level of a video signal changes (increases or decreases). Overshoot drive is disclosed in, for example, Patent Document 1.

The second factor is that hold-type display elements are used for keeping brightness at an approximately constant level over one frame cycle of video. Concerning this point, Patent Document 2 describes that, in the case of an image display device provided with hold-type display elements, when displaying a moving image, the moving image might appear blurry due to the viewer's following line of sight. To prevent such a moving image blur, the hold time of the display elements is required to be shortened, and specific methods known for this are frame interpolation drive for shortening the length of one frame cycle of video, and time-division gradation drive (pseudo-impulse drive) for approximation to impulse-type light emission as in CRTs. Frame interpolation drive using motion vectors is disclosed in, for example, Patent Document 3, and time-division gradation drive is disclosed in, for example, Patent Document 4.

In addition, Patent Document 5 discloses a drive mode combining frame interpolation drive, in which a frame for compensating for motion of an object image is created and interposed between frames to achieve an increased refresh rate, and overdrive. In this drive mode, an overdrive correction circuit is disposed at the subsequent stage of a frame converter circuit. The frame converter circuit suppresses occurrence of any moving image blur due to the viewer's following line of sight, while the overdrive correction circuit makes up for the lack of response-speed of the liquid crystal display elements, which improves moving image display performance.

[Patent Document 1] Japanese Patent No. 2650479 Publication

[Patent Document 2] Japanese Laid-Open Patent Publication No. 9-325715

[Patent Document 3] Japanese Laid-Open Patent Publication No. 2001-42831

[Patent Document 4] Japanese Laid-Open Patent Publication No. 2005-173573

[Patent Document 5] Japanese Laid-Open Patent Publication No. 2005-91454

DISCLOSURE OF THE INVENTION

Problems to be Solved by the Invention

As mentioned above, although Patent Document 5 discloses a method for improving moving image display performance using frame interpolation drive and overshoot drive, this method is not applicable to image display devices performing time-division gradation drive. Therefore, when attempting to improve moving image display performance of image display devices with display elements having a slow response speed by suppressing occurrence of any moving image blur due to the viewer's following line of sight via time-division gradation drive, a new problem arises where false contours appear on the screen.

Referring to FIGS. 27 to 29, the cause of the appearance of false contours will be described. An image display device in which brightness is distributed to two sub-frames obtained by halving one frame cycle of video into first and second portions, such that the sum of time integration values of brightness for the two sub-frames is equal to brightness for one frame cycle, is taken as an example of the image display device performing time-division gradation drive. However, it should be noted that brightness is preferentially distributed to the second sub-frame, and the first sub-frame has brightness distributed thereto only when the maximum brightness is distributed to the second sub-frame.

A case is considered where the gradation level of a video signal provided to fifteen horizontally-neighboring pixels (display elements) in this image display device changes as shown in FIG. 27. FIG. 27 shows a gradation level change over six frame cycles of the video signal provided to the fifteen pixels horizontally neighboring across the boundary between two regions displayed on the screen, one being a region where the gradation level is 0 during the first sub-frame and 255 during the second sub-frame, the other being a region where the gradation level is 0 during both the first and second sub-frames, the boundary moving horizontally rightward at a rate of two pixels per frame.

In this case, if the display elements have a response speed slower than a speed corresponding to one sub-frame-cycle of video, brightness of a pixel of interest shown in FIG. 27 changes, for example, as shown in FIG. 28. Note that brightness shown in FIG. 28 is the value converted to the gradation level in hold-type display. Brightness of the pixel of interest is controlled to be 0 during the first sub-frame and 255 during the second sub-frame in the third and subsequent frames. However, in reality, the display elements have a response speed slower than a speed corresponding to one sub-frame cycle, and therefore brightness of the pixel of interest only reaches 238 during the second sub-frame in the third frame, and 6 and 242 during-the first and second sub-frames, respectively, in the fourth and subsequent frames. Therefore, pixels around the boundary may vary from other pixels in terms of the minimum brightness during the first sub-frame and the maximum brightness during the second sub-frame.

The viewer visually perceives the boundary which exhibits the brightness response waveform shown in FIG. 28, while temporally integrating display brightness along movement of the line of sight. As a result, the viewer sees brightness around the boundary as shown in FIG. 29. The time integration value for brightness changes in accordance with the horizontal display position as shown in FIG. 29, but there is a point (inflection point) with a small amount of change in time integration value for brightness, and therefore, there appear before and after the inflection point, two points with a large amount of change in time integration value for brightness. The points with a large amount of change in time integration value for brightness are recognized as contours, and in this case, the viewer visually perceives two contours (first and second contours) which are true and false contours, respectively.

Therefore, an objective of the present invention is to provide an image display device capable of improving moving image display performance, while making up for a lack of response speed of display elements.

Solution to the Problems

A first aspect of the present invention is directed to an image display device for providing a gradation display based on a video signal, comprising: a plurality of display elements; a drive circuit for driving the display elements; a video conversion circuit for obtaining a video signal in units of sub-frames based on a video signal inputted in units of frames; a time-division gradation process circuit for performing gradation level conversion on a video signal outputted from the video conversion circuit to distribute brightness for one frame cycle to a plurality of sub-frame cycles; and an overshoot process circuit for performing gradation level conversion on a video signal outputted from the time-division gradation process circuit to emphasize a temporal change of the signal, and outputting a resultant video signal to the drive circuit.

In a second aspect of the present invention, based on the first aspect of the invention, the video conversion circuit includes a predetermined-times higher speed process circuit for outputting the input video signal a plurality of times in units of frames.

In a third aspect of the present invention, based on the first aspect of the invention, the video conversion circuit includes: a frame interpolation process circuit for performing an interpolation process on the input video signal in units of frames; and a predetermined-times higher speed process circuit for outputting a video signal outputted from the frame interpolation process circuit a plurality of times in units of frames.

In a fourth aspect of the present invention, based on the first aspect of the invention, the video conversion circuit includes a frame interpolation process circuit for performing an interpolation process on the input video signal in units of frames.

In a fifth aspect of the present invention, based on the first aspect of the invention, the video conversion circuit includes one or more video processing circuits for processing the video signal, the video processing circuit and the time-division gradation process circuit switch between processing and not processing the video signal in accordance with a control signal, and the overshoot process circuit performs a different type of gradation level conversion in accordance with the control signal.

In a sixth aspect of the present invention, based on the first aspect of the invention, the overshoot process circuit performs gradation level conversion on a video signal outputted from the time-division gradation process circuit, such that brightness of the display elements after one sub-frame cycle corresponds to a pre-conversion gradation level of the video signal.

In a seventh aspect of the present invention, based on the first aspect of the invention, the overshoot process circuit performs the gradation level conversion only when a video signal outputted from the time-division gradation process circuit changes by a predetermined value or more from an immediately previous sub-frame.

In an eighth aspect of the present invention, based on the first aspect of the invention, where maximum reachable brightness value signifies brightness of the display elements after one sub-frame cycle since a gradation level of a video signal provided to the display elements changed from minimum to maximum, and minimum reachable brightness value signifies brightness of the display elements after one sub-frame cycle since the gradation level of the video signal provided to the display elements changed from maximum to minimum, the time-division gradation process circuit outputs a value between the minimum reachable brightness value and the maximum reachable brightness value as a post-conversion gradation level when a gradation level of the video signal outputted from the video conversion circuit is between the minimum reachable brightness value and the maximum reachable brightness value.

In a ninth aspect of the present invention, based on the eighth aspect of the invention, the time-division gradation process circuit outputs a pre-conversion gradation level as the post-conversion gradation level when the gradation level of the video signal outputted from the video conversion circuit is less than the minimum reachable brightness value or greater than the maximum reachable brightness value.

In a tenth aspect of the present invention, based on the first aspect of the invention, the display elements have a response speed slower than a speed corresponding to one sub-frame cycle.

In an eleventh aspect of the present invention, based on the tenth aspect of the invention, the display elements are liquid crystal display elements.

In a twelfth aspect of the present invention, based on the tenth aspect of the invention, the display elements are electroluminescence elements.

Effect of the Invention

According to the first aspect of the present invention, the overshoot process circuit is provided at the subsequent stage of the time-division gradation process circuit, and time-division gradation drive and overshoot drive are performed. Time-division gradation drive makes it possible to suppress occurrence of any moving image blur, and overshoot drive makes is possible to make up for a lack of response speed of the display elements. Accordingly, it is possible to improve moving image display performance, while making up for the lack of response speed of the display elements.

According to the second aspect of the present invention, a predetermined-times higher speed process is performed on an input video signal to obtain a video signal in units of sub-frames. Accordingly, by suppressing occurrence of any moving image blur via time-division gradation drive, and making up for a lack of response speed of the display elements via overshoot drive, it becomes possible to improve moving image display performance, while making up for the lack of response speed of the display elements.

According to the third aspect of the present invention, a frame interpolation process and a predetermined-times higher speed process are performed on an input video signal to obtain a video signal in units of sub-frames. Accordingly, by suppressing occurrence of any moving image blur via the frame interpolation process and time-division gradation drive, and making up for a lack of response speed of the display elements via overshoot drive, it becomes possible to improve moving image display performance, while making up for the lack of response speed of the display elements.

According to the fourth aspect of the present invention, a frame interpolation process is performed on an input video signal to obtain a video signal in units of sub-frames. Accordingly, by suppressing occurrence of any moving image blur via the frame interpolation process and time-division gradation drive, and making up for a lack of response speed of the display elements via overshoot drive, it becomes possible to improve moving image display performance, while making up for the lack of response speed of the display elements.

According to the fifth aspect of the present invention, by selectively operating the video processing circuit and the time-division gradation process circuit using a control signal, it is possible to switch between modes of driving the display elements. In addition, the overshoot process circuit is provided for performing a different type of gradation level conversion in accordance with the control signal, and therefore it is possible to eliminate the need to provide an overshoot process circuit for each drive mode, resulting in a reduction in the cost of the image display device.

According to the sixth aspect of the present invention, by performing gradation level conversion after the time-division gradation process, such that brightness of the display elements after one sub-frame cycle corresponds to the pre-conversion gradation level of the video signal, it becomes possible to control the brightness of the display elements to be at a desired level after one sub-frame cycle, thereby making up for a lack of response speed of the display elements.

According to the seventh aspect of the present invention, by performing gradation level conversion via the overshoot process circuit only when a video signal outputted from the time-division gradation process circuit changes by a predetermined value or more from the immediately previous sub-frame, it becomes possible to prevent any false operation due to noise contamination.

According to the eighth aspect of the present invention, when the gradation level of a video signal outputted from the video conversion circuit lies between the minimum reachable brightness value and the maximum reachable brightness value, it is possible to allow the brightness of the display elements to reach a desired level within one sub-frame cycle.

According to the ninth aspect of the present invention, even when the gradation level of a video signal outputted from the video conversion circuit does not lie between the minimum reachable brightness value and the maximum reachable brightness value, it is possible to allow the brightness of the display elements to reach a desired level within a short period of time.

According to the tenth aspect of the present invention, even when the display elements have a response speed slower than a speed corresponding to one sub-frame cycle, by suppressing occurrence of any moving image blur via time-division gradation drive and making up for a lack of response speed of the display elements via overshoot drive, it becomes possible to improve moving image display performance, while making up for the lack of response speed of the display elements.

According to the eleventh aspect of the present invention, it is possible to provide a liquid crystal display device capable of improving moving image display performance, while making up for a lack of response speed of the display elements.

According to the twelfth aspect of the present invention, it is possible to provide an electroluminescence display device capable of improving moving image display performance, while making up for a lack of response speed of the display elements.

BRIEF DESCRIPTION OF THE DRAWINGS

FIG. 4 is a diagram illustrating an exemplary change of a video signal inputted to the liquid crystal display device shown in FIG. 1.

FIG. 5 is a diagram illustrating an exemplary change of an output signal of a simple double-speed process circuit in the liquid crystal display device shown in FIG. 1.

FIG. 6 is a diagram illustrating an exemplary change of an output signal of a time-division gradation process circuit in the liquid crystal display device shown in FIG. 1.

FIG. 7 is a diagram illustrating an exemplary change of an output signal of an overshoot process circuit in the liquid crystal display device shown in FIG. 1.

FIG. 20 is a diagram illustrating an exemplary change of a video signal inputted to the liquid crystal display device shown in FIG. 18.

FIG. 21 is a diagram illustrating-an exemplary change of an output signal of a frame interpolation process circuit in the liquid crystal display device shown in FIG. 18.

FIG. 22 is a diagram illustrating an exemplary change of an output signal of a time-division gradation process circuit in the liquid crystal display device shown in FIG. 18.

FIG. 23 is a diagram illustrating an exemplary change of an output signal of an overshoot process circuit in the liquid crystal display device shown in FIG. 18.

FIG. 27 is a diagram illustrating an exemplary change of a video signal inputted to a conventional display device.

DESCRIPTION OF THE REFERENCE CHARACTERS

Figure 1:
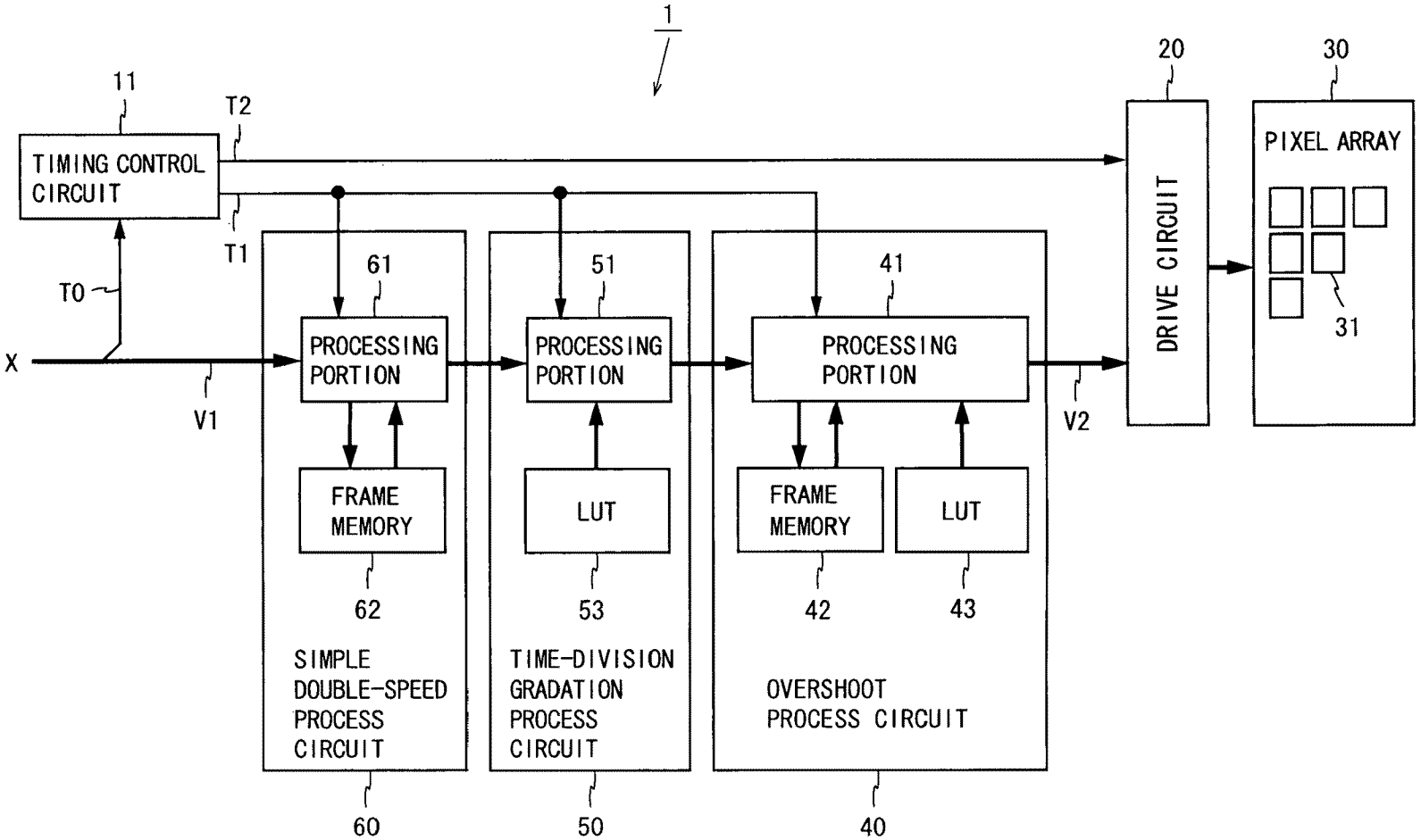
FIG. 1 is a block diagram illustrating the configuration of a liquid crystal display device according to a first embodiment of the present invention.

1, 2, 3, 4 liquid crystal display device
11, 12, 13 timing control circuit
20 drive circuit
30 pixel array
31 liquid crystal display element
40, 45 overshoot process circuit
50, 55 time-division gradation process circuit
60, 65 simple double-speed process circuit
70, 75 frame interpolation process circuit
41, 46, 51, 56, 61, 66, 71, 76 processing portion
42, 62, 72 frame memory
43, 53 LUT

BEST MODE FOR CARRYING OUT THE INVENTION

First Embodiment

FIG. 1 is a block diagram illustrating the configuration of a liquid crystal display device according to a first embodiment of the present invention. The liquid crystal display device 1 shown in FIG. 1 includes a timing control circuit 11, a drive circuit 20, a pixel array 30, an overshoot process circuit 40, a time-division gradation process circuit 50, and a simple double-speed process circuit 60. The liquid crystal display device 1 performs three processes (a simple double-speed process, a time-division gradation process, and an overshoot process) on a video signal V1, and provides a gradation display using a resultant video signal V2. In the present embodiment, the simple double-speed process circuit 60 constitutes a video conversion circuit for obtaining a video signal in units of sub-frames based on a video signal inputted in units of frames.

An input signal X to be supplied to the liquid crystal display device 1 includes the video signal V1 representing image data, and a synchronization signal T0 for setting display timing. The video signal V1 is inputted to the simple double-speed process circuit 60, whereas the synchronization signal T0 is inputted to the timing control circuit 11. Based on the synchronization signal T0, the timing control circuit 11 outputs a synchronization signal T1 to the simple double-speed process circuit 60, the time-division gradation process circuit 50, and the overshoot process circuit 40, while outputting a synchronization signal T2 to the drive circuit 20. The pixel array 30 includes a plurality of liquid crystal display elements 31, which are arranged two-dimensionally. The drive circuit 20 drives the liquid crystal display elements 31 based on the synchronization signal T2, and the video signal V2 outputted from the overshoot process circuit 40. As a result, the liquid crystal display device 1 displays a screen.

Hereinafter, it is assumed that the video signals V1 and V2 are eight-bit signals each representing a gradation level from 0 to 255, and brightness of the liquid crystal display elements 31 is minimized when the gradation level is 0, and maximized when the gradation level is 255. Also, in the liquid crystal display device 1, the video signal V1 has a refresh rate of 60 Hz.

The simple double-speed process circuit 60 includes a processing portion 61 and a frame memory 62, and outputs the video signal V1 twice at a double speed in units of frames (hereinafter, this process will be referred to as a "simple double-speed process"). More specifically, the frame memory 62 has a capacity capable of memorizing a video signal for at least one frame, and the video signal V1 inputted to the simple double-speed process circuit 60 is written onto the frame memory 62. The processing portion 61 reads the video signal written on the frame memory 62 twice at double the writing speed in units of frames. As a result, a video signal to be outputted from the simple double-speed process circuit 60 has twice (120 Hz) the refresh rate of the video signal V1.

The time-division gradation process circuit 50 includes a processing portion 51 and a lookup table (hereinafter, referred to as an "LUT") 53, and performs gradation level conversion on the video signal outputted from the simple double-speed process circuit 60 in order to distribute brightness for one frame cycle to two sub-frame cycles, i.e., the first and second sub-frame cycles. In the time-division gradation process circuit 50, the gradation level conversion is performed for distributing the brightness to the two sub-frames such that the sum of time integration values for brightness of the first and second sub-frames is equalized with the brightness for one frame cycle. At this time, the brightness is preferentially distributed to the second sub-frame, and the first sub-frame has the brightness distributed thereto only when the brightness is distributed to the second sub-frame to a certain great extent. As such, by preferentially distributing the brightness to the second sub-frame, it becomes possible to perform pseudo-impulse drive.

The LUT 53 has previously stored therein gradation levels for the first and second sub-frames in association with pre-distribution gradation levels. The gradation levels for the first and second sub-frames are determined so as to satisfy the above conditions (i.e., the sum of the time integration values for brightness of the first and second sub-frames is equalized with brightness for one frame cycle, and the brightness is preferentially distributed to the second sub-frame). The processing portion 51 treats the gradation level of the video signal outputted from the simple double-speed process circuit 60 as a pre-distribution gradation level, and uses this value and information indicating either the first or second sub-frame to refer the LUT 53. In this manner, the processing portion 51 30 uses the LUT 53 to perform gradation level conversion for distributing the brightness for one frame cycle to the two sub-frame cycles, i.e., the first and second sub-frame cycles.

The overshoot process circuit 40 includes a processing portion 41, a frame memory 42, and an LUT 43, and subjects the video signal outputted from the time-division gradation process circuit 50 to gradation level conversion for emphasizing a temporal change of the signal. More specifically, the frame memory 42 has a capacity capable of memorizing a video signal for at least one frame, and a video signal inputted to the overshoot process circuit 40 is written onto the frame memory 42. The LUT 43 has previously stored therein post-conversion gradation levels in association with combinations of pre-conversion gradation levels and immediately previous sub-frame gradation levels. The processing portion 41 refers the LUT 43 using the gradation level of the video signal outputted from the time-division gradation process circuit 50 as a pre-conversion gradation level, and the gradation level of the video signal memorized in the frame memory 42 as an immediately previous sub-frame gradation level. In this manner, the processing portion 41 uses the frame memory 42 and the LUT 43 to perform the gradation level conversion for emphasizing a temporal change of the signal. Note that the LUTs 43 and 53 are each configured by, for example, a ROM or suchlike.

Figure 2:
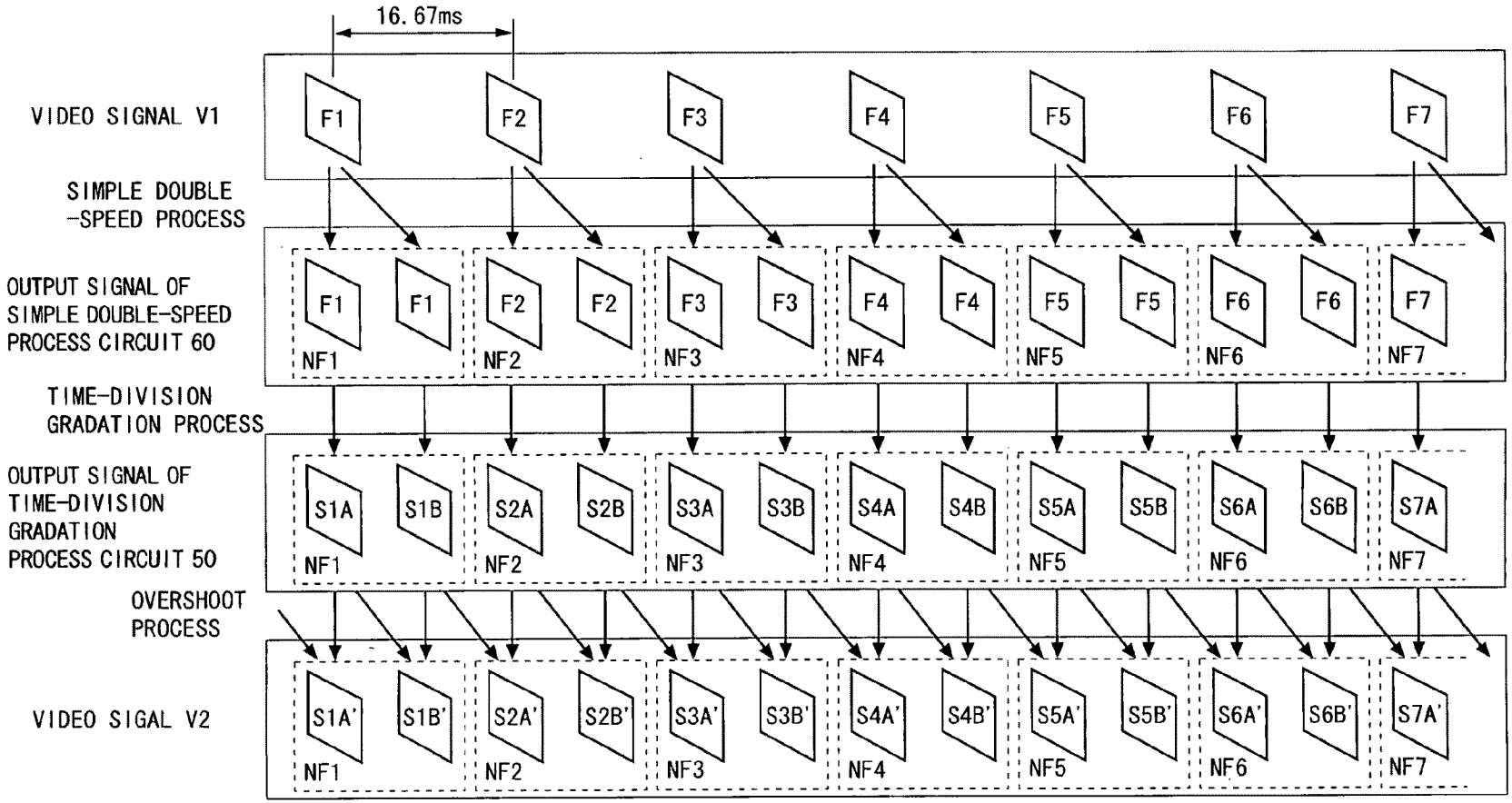
FIG. 2 is a diagram illustrating a frame-by-frame process flow in the liquid crystal display device shown in FIG. 1.

FIG. 2 is a diagram illustrating a frame-by-frame process flow in the liquid crystal display device 1. When the video signal V1 has a refresh rate of 60 Hz, the simple double-speed process circuit 60 receives frames F1, F2, . . . , each being inputted every 16.67 ms. The frame F1 is simply doubled in speed by the simple double-speed process circuit 60 to become a new frame NF1 consisting of two sub-frames having the same content. The two sub-frames included in the frame NF1 are converted to first and second sub-frames S1A and S1B in the time-division gradation process circuit 50. The first sub-frame S1A is converted to a first sub-frame S1A' by the overshoot process circuit 40 referring the second sub-frame immediately previous thereto (not shown). The second sub-frame S1B is converted to a second sub-frame S1B' by the overshoot process circuit 40 referring the first sub-frame S1A immediately previous thereto. Similarly, frames F2, F3, . . . , included in the video signal V1 are converted to sub-frames S2A', S2B', S3A', S3B', . . . , respectively.

Figure 3:
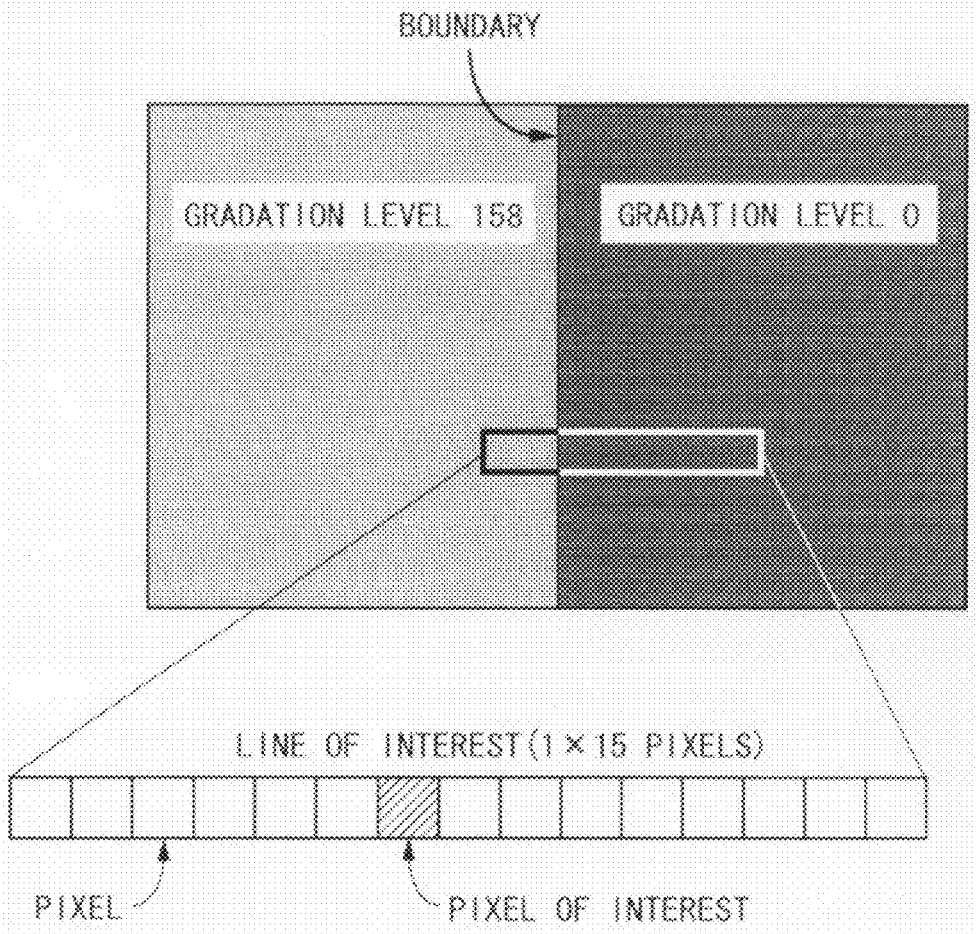
FIG. 3 is a diagram illustrating an exemplary display screen of the liquid crystal display device shown in FIG. 1.

The change in gradation level for each pixel in the liquid crystal display device 1 will be described below. Here, an example as shown in FIG. 3 is considered where a region at a gradation level of 158 and a region at a gradation level of 0 are displayed on the screen, and-the boundary between the two regions moves horizontally rightward at a rate of two pixels per frame. In addition, a region of 1 pixel high×15 pixels wide within the screen is referred to as a "line of interest", and a pixel in the line of interest (the seventh pixel from the left) is referred to as a "pixel of interest".

FIGS. 4 to 7 are diagrams illustrating exemplary changes over six frame cycles of the video signal V1, an output signal of the simple double-speed process circuit 60, an output signal of the time-division gradation process circuit 50, and the video signal V2, in relation to pixels in the line of interest. In FIGS. 4 to 7, the horizontal axis denotes the horizontal display positions of the pixels, whereas the vertical axis denotes time in units of frame cycles or sub-frame cycles.

Figure 8:
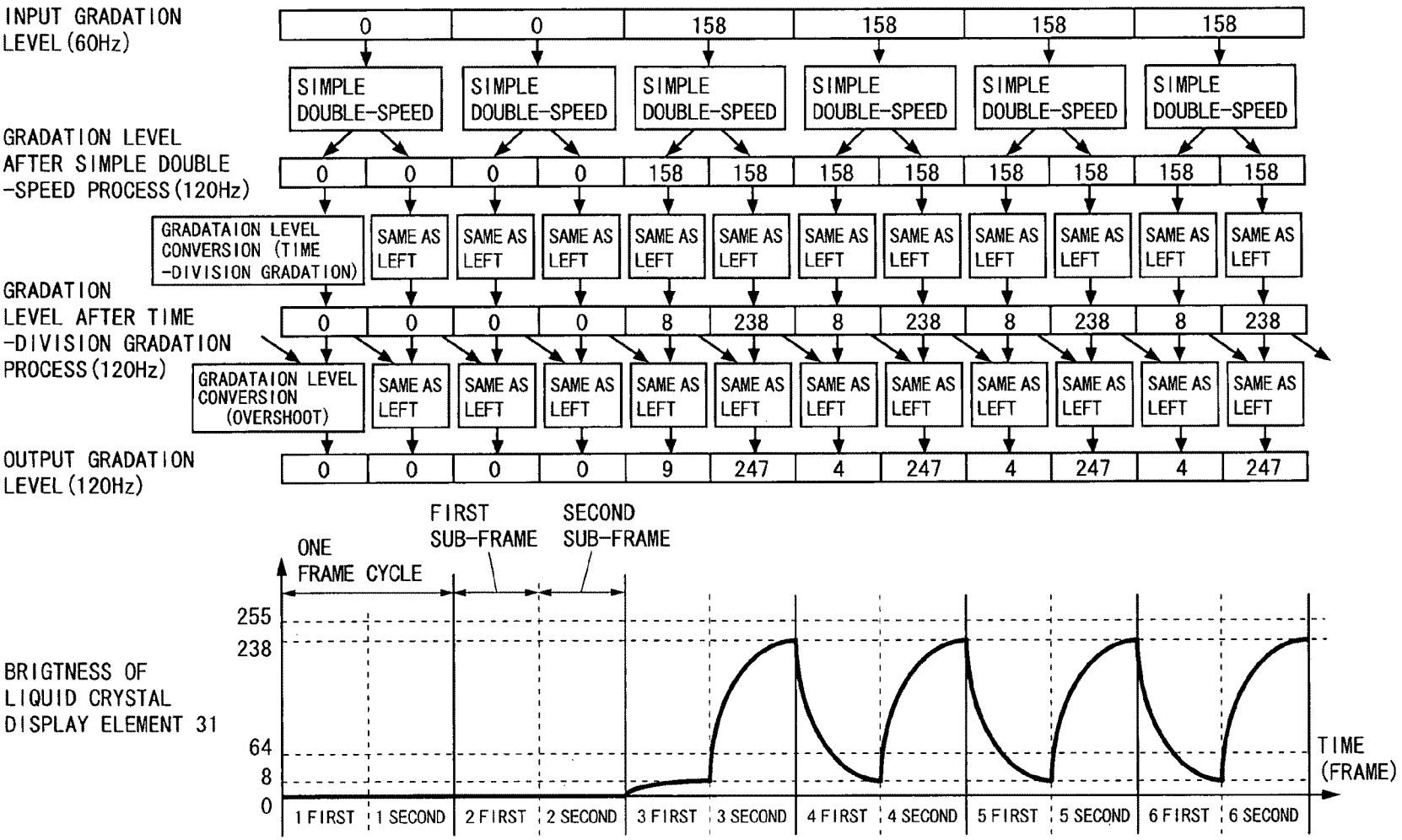
FIG. 8 is a diagram illustrating exemplary changes in gradation level of a video signal and in brightness of a liquid crystal display element, in relation to a pixel in the liquid crystal display device shown in FIG. 1.

FIG. 8 is a diagram illustrating changes over six frame cycles in gradation level of the video signal and in brightness of the liquid crystal display element 31, in relation to the pixel of interest. Note that brightness shown in FIG. 8 is the value converted to the gradation level in hold-type display (the same applies to the following figures). In the simple double-speed process by the simple double-speed process circuit 60, the refresh rate of the video signal is doubled, but the gradation level of the video signal does not change. Accordingly, when the input gradation level (the gradation level of the video signal V1) is 0, the gradation level after the simple double-speed process is also 0, and when the input gradation level is 158, the gradation level after the simple double-speed process is also 158.

In the time-division gradation process circuit 50, the video signal during the first sub-frame and the video signal during the second sub-frame are subjected to different types of gradation level conversion. Accordingly, in general, the post-conversion gradation level varies between the first and second sub-frames. For example, in the example shown in FIG. 8, when the input gradation level is 0, the post-conversion gradation level is 0 during both the first and second sub-frames, but when the input gradation level is 158, the post-conversion gradation level is 8 during the first sub-frame, and 238 during the second sub-frame.

Note that when performing time-division gradation drive, it is desirable to distribute brightness to the second sub-frame as much as possible, and therefore the first sub-frame might have brightness distributed thereto only when the maximum brightness is distributed to the second sub-frame. However, in the time-division gradation process circuit 50, even when the maximum brightness is not distributed to the second sub-frame, the first sub-frame has brightness distributed thereto. For example, in the example shown in FIG. 8, when the input gradation level is 158, the post-conversion gradation level is 8 during the first sub-frame (the minimum is not 0), and 238 during the second sub-frame (the maximum is not 255). The reason why the time-division gradation process circuit 50 performs such gradation level conversion will be described later.

In the overshoot process circuit 40, gradation level conversion is performed in order to emphasize a temporal change of the signal. More specifically, in the overshoot process circuit 40, the video signal outputted from the time-division gradation process circuit 50 is subjected to a gradation level such that brightness (the value converted to the gradation level in hold-type display) of the liquid crystal display elements 31 after one sub-frame cycle corresponds to the pre-conversion gradation level of the video signal. Concretely, when the gradation level of the immediately previous sub-frame is lower than that of the current sub-frame, the gradation-level of the video signal is converted such that the maximum brightness of the liquid crystal display elements 31 after one sub-frame cycle corresponds to the pre-conversion gradation level of the video signal. When the gradation level of the immediately previous sub-frame is higher than that of the current sub-frame, the gradation level of the video signal is converted such that the minimum brightness of the liquid crystal display elements 31 after one sub-frame cycle corresponds to the pre-conversion gradation level of the video signal. By performing such gradation level conversion, it becomes possible to make up for a lack of response speed of the liquid crystal display elements 31.

Figure 9:
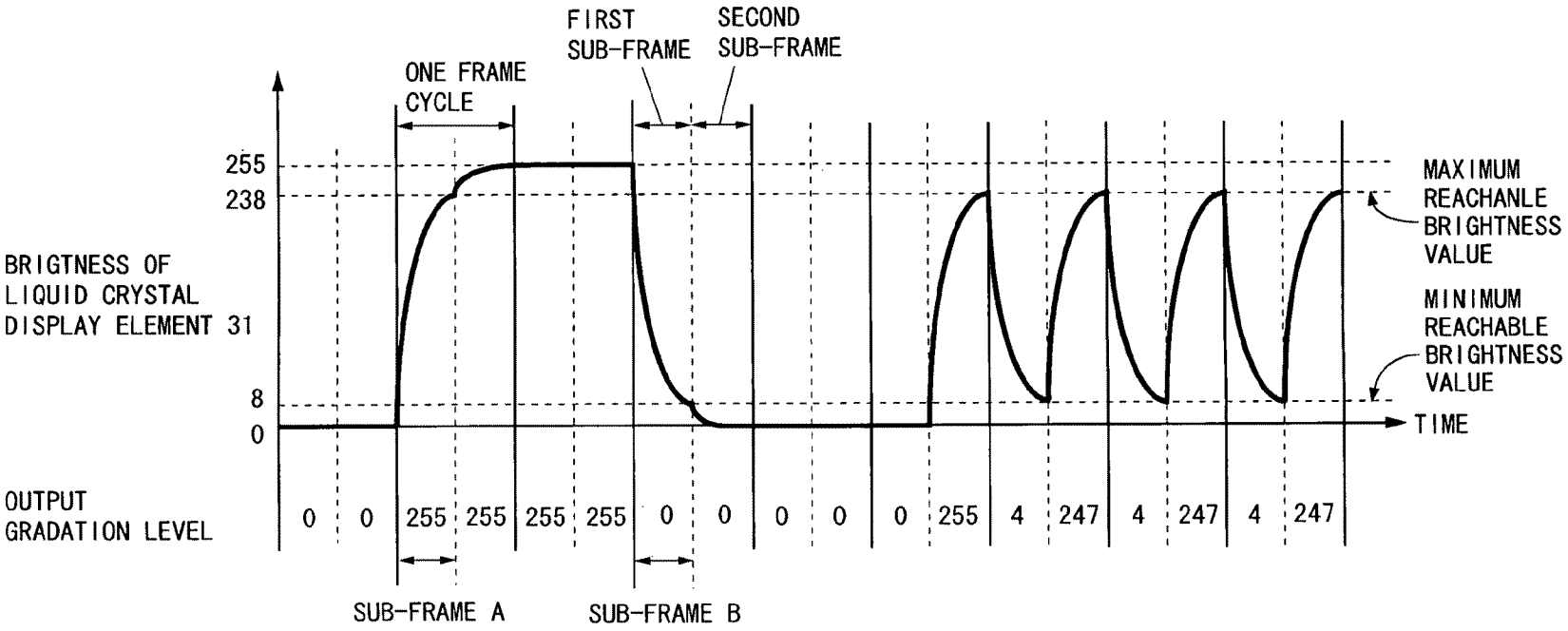
FIG. 9 is a diagram illustrating exemplary changes in gradation level of a video signal provided to liquid crystal display elements and in brightness of the liquid crystal display elements in the liquid crystal display device shown in FIG. 1.

Hereinafter, the overshoot process circuit 40 will be described in detail with specific examples. FIG. 9 is a diagram illustrating changes in gradation level of the video signal V2 provided to the liquid crystal display elements 31 and in brightness of the liquid crystal display elements 31. It should be noted that the video signal V2 has a refresh rate of 120 Hz, and the liquid crystal display elements 31 have a response speed slower than a speed corresponding to a sub-frame cycle (8.3 ms).

In FIG. 9, the gradation level of the video signal V2 changes from the minimum 0 to the maximum 255 during the sub-frame A, but the brightness of the liquid crystal display elements 31 does not reach the maximum 255 at the end of the sub-frame A, only rising to a smaller value of 238. In addition, the gradation level of the video signal V2 changes from the maximum 255 to the minimum 0 during the sub-frame B, but the brightness of the liquid crystal display elements 31 does not reach the minimum 0 at the end of the sub-frame B, only falling to a greater value of 8.

Such brightness of the display elements after one sub-frame cycle since the gradation level of the video signal provided to the display elements changed from minimum to maximum is referred to as "maximum reachable brightness value", whereas the brightness of the display elements after one sub-frame cycle since the gradation level of the video signal provided to the display elements changed from maximum to minimum is referred to as "minimum reachable brightness value". In the example shown in FIG. 9, the maximum reachable brightness value is 238, and the minimum reachable brightness value is 8.

The post-conversion gradation level in the overshoot process circuit 40 is determined by, for example, the following method based on an actual measurement for the brightness response waveform of the liquid crystal display elements 31. Specifically, after supplying a video signal at a given gradation level to the liquid crystal display elements 31 over a sufficiently long period of time, and setting the liquid crystal display elements 31 at a predetermined brightness level, the liquid crystal display elements 31 are measured for brightness after one sub-frame cycle since the gradation level of the video signal changed, so that the post-conversion gradation level can be obtained based on the actual measurement.

For example, during the sub-frame A shown in FIG. 9, the gradation level of the video signal changes from 0 to 255, and correspondingly, the brightness of the liquid crystal display elements 31 changes from 0 to238. Accordingly, when the gradation level of the immediately previous sub-frame is 0, and the gradation level of the current sub-frame is 238, the post-conversion gradation level is determined to be 255. In addition, during the sub-frame B shown in FIG. 9, the gradation level of the video signal changes from 255 to 0, and correspondingly, the brightness of the liquid crystal display elements 31 changes from 255 to 8. Accordingly, when the gradation level of the immediately previous sub-frame is 255, and the gradation level of the current sub-frame is 8, the post-conversion gradation level is determined to be 0.

With this method, the post-conversion gradation level can be determined for most combinations of the gradation levels of the immediately previous sub-frame and the current sub-frame. However, with this method alone, it is not possible to determine the post-conversion gradation level when the amount of change in gradation level is large. Therefore, when the gradation level of the immediately previous sub-frame is smaller than that of the current sub-frame, and the amount of change in gradation level is large, the post-conversion gradation level is determined to be the maximum 255, and when the gradation level of the immediately previous sub-frame is greater than that of the current sub-frame, and the amount of change in gradation level is large, the post-conversion gradation level is determined to be the minimum 0. In the example shown in FIG. 9, when the gradation level changes from 7 to 239, or when the gradation level changes from 0 to 255, the post-conversion gradation level is determined to be the maximum 255, and when the gradation level changes from 239 to 7, or when the gradation level changes from 255 to 0, the post-conversion gradation level is determined to be the minimum 0. In this manner, the post-conversion gradation level can be determined for all combinations of the gradation levels of the immediately previous sub-frame and the current sub-frame.

Note that the post-conversion gradation level in the overshoot process circuit 40 may be determined as well by any method other than the above. For example, when the difference in gradation level between the immediately previous sub-frame and the current sub-frame is less than a predetermined value, the post-conversion gradation level may be determined to be the same value as the pre-conversion gradation level. In this case, the overshoot process circuit 40 performs gradation level conversion only when the video signal outputted from the time-division gradation process circuit 50 changes by a predetermined value or more from the immediately previous sub-frame. This makes it possible to prevent any false operation due to noise contamination.

Figure 10:
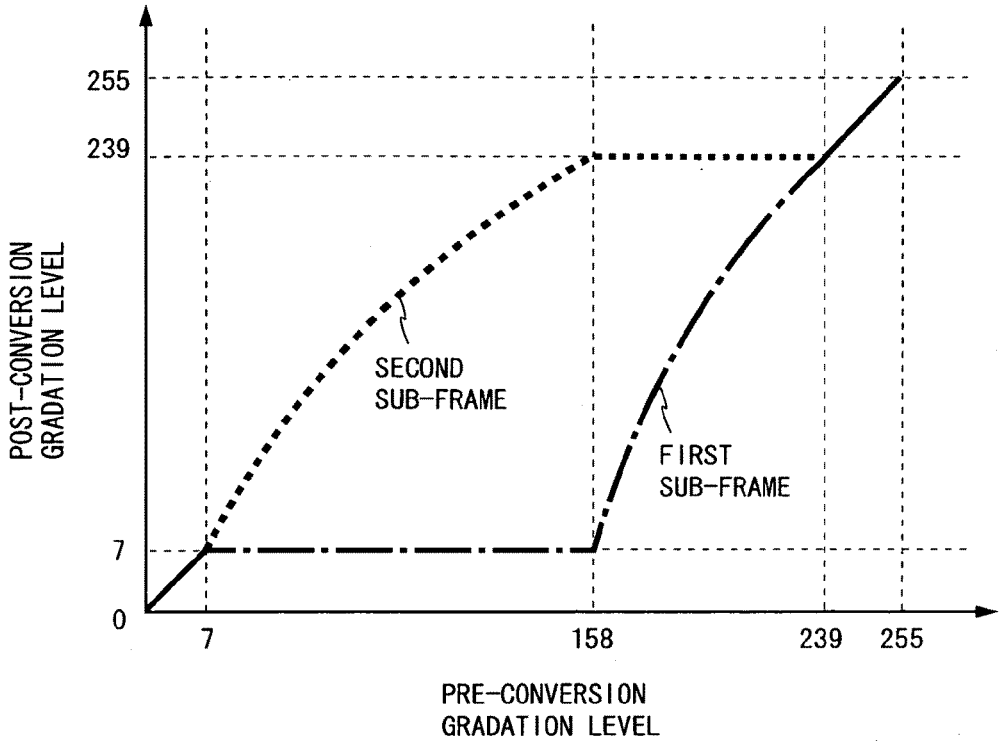
FIG. 10 is a graph illustrating characteristics of gradation level conversion by the time-division gradation process circuit in the liquid crystal display device shown in FIG. 1.

Hereinafter, the time-division gradation process circuit 50 will be described in detail with specific examples. FIG. 10 is a graph illustrating characteristics of the gradation level conversion by the time-division gradation process circuit 50. In FIG. 10, the horizontal axis denotes the pre-conversion gradation level, and the vertical axis denotes the post-conversion gradation level. In FIG. 10, the post-conversion gradation level is indicated by the dashed line for the first sub-frame and by the broken line for the second sub-frame.

As shown in FIG. 10, when the pre-conversion gradation level is either 7 or less, or 239 or more, the post-conversion gradation level is the same as the pre-conversion gradation level during both the first and second sub-frames. In addition, when the pre-conversion gradation level is from 8 to less than 158, the post-conversion gradation level is 7 during the first sub-frame, and a value corresponding to the pre-conversion gradation level during the second sub-frame. In addition, when the pre-conversion gradation level is from 158 to 238, the post-conversion gradation level is 239 during the second sub-frame, and a value corresponding to the pre-conversion gradation level during the first sub-frame.

The reason for determining in such a way the post-conversion gradation level in the time-division gradation process circuit 50 is as follows. In the example shown in FIG. 9, the maximum reachable brightness value of the liquid crystal display elements 31 is 238, and the minimum reachable brightness value is 8. Accordingly, when the gradation level of the video signal V2 is between the minimum reachable brightness value and the maximum reachable brightness value, the brightness of the liquid crystal display elements 31 after one sub-frame cycle since the gradation level of the video signal V2 changed is always at a desired level. Therefore, when the pre-conversion gradation level is between the minimum reachable brightness value 8 and the maximum reachable brightness value 238, the time-division gradation process circuit 50 outputs a value between the minimum reachable brightness value 8 and the maximum reachable brightness value 238 as the post-conversion gradation level. This makes it possible to allow the brightness of the liquid crystal display elements 31 to reach a desired level within one sub-frame cycle.

In addition, when the pre-conversion gradation level is less than the minimum reachable brightness value 8 or greater than the maximum reachable brightness value 238, the time-division gradation process circuit 50 outputs the pre-conversion gradation level as the post-conversion gradation level during both the first and second sub-frames. As a result, the video signal is not converted into impulse form, and therefore the effect of suppressing occurrence of any moving image blur is slightly reduced, but the brightness of the liquid crystal display elements 31 reaches a desired level within a short period of time (e.g., within two sub-frame cycles).

When using the time-division gradation process circuit 50 and the overshoot process circuit 40 thus configured, the brightness of the pixel of interest is 8 during the first sub-frame and 238 during the second sub-frame in the third and subsequent frames, as shown in FIG. 8, and pixels around the boundary coincide with other-pixels in terms of the minimum brightness during the first sub-frame and the maximum brightness during the second sub-frame.

Figure 11:
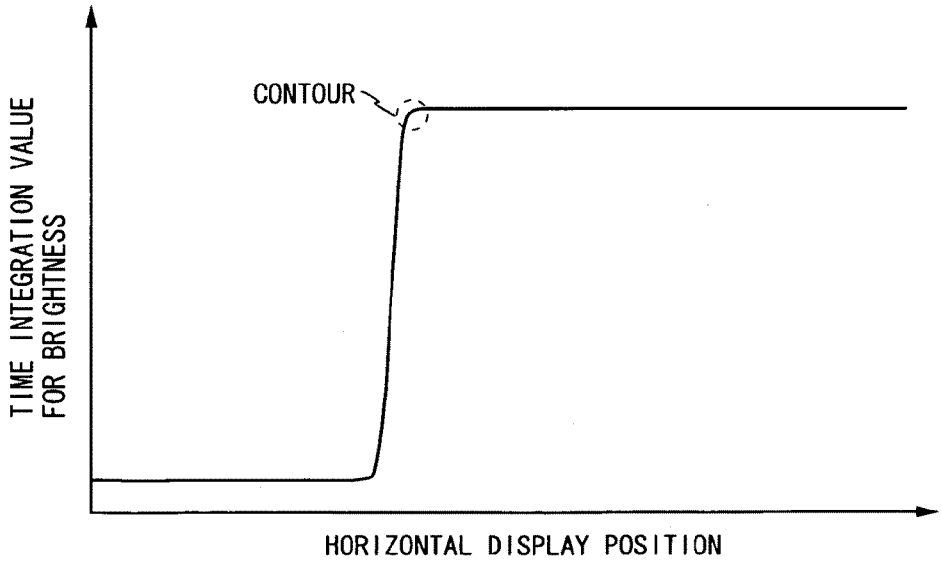
FIG. 11 is a graph illustrating a change in brightness around a boundary, as seen by the viewer, in the liquid crystal display device shown in FIG. 1.
Figure 29:
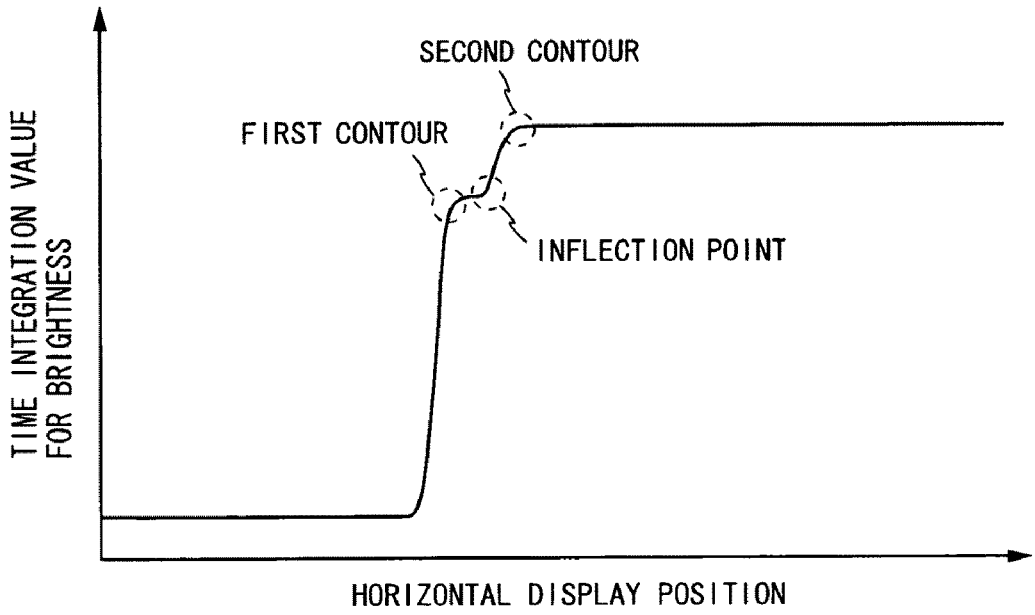
FIG. 29 is a diagram illustrating a change in brightness around a boundary, as seen by the viewer, in the conventional display device.

The viewer visually perceives the boundary exhibiting the brightness response waveform shown in FIG. 8, while temporally integrating display brightness along movement of the line of sight. Therefore, the viewer sees brightness around the boundary as shown in FIG. 11. The time integration value for brightness changes in accordance with the horizontal display position, as shown in FIG. 11, but unlike in conventional display devices (see FIG. 29), there is no point (inflection point) with a small amount of change in time integration value for brightness, and therefore there appears only one point with a large amount of change in time integration value for brightness. The point with a large amount of change in time integration value for brightness is perceived as a contour, and therefore in this case, the viewer visually perceives only one contour. In this manner, the liquid crystal display device 1 makes it possible to suppress occurrence of any false contour different from a true contour.

As described above, in the liquid crystal display device 1 according to the present embodiment, the overshoot process circuit 40 is provided at the subsequent stage of the time-division gradation process circuit 50, and time-division gradation drive and overshoot drive are performed. Time-division gradation drive makes it possible to suppress occurrence of any moving image blur, and overshoot drive makes it possible to make up for a lack of response speed of the liquid crystal display elements 31. Accordingly, the liquid crystal display device 1 makes it possible to improve moving image display performance, while making up for the lack of response speed of the display elements.

Second Embodiment

Figure 12:
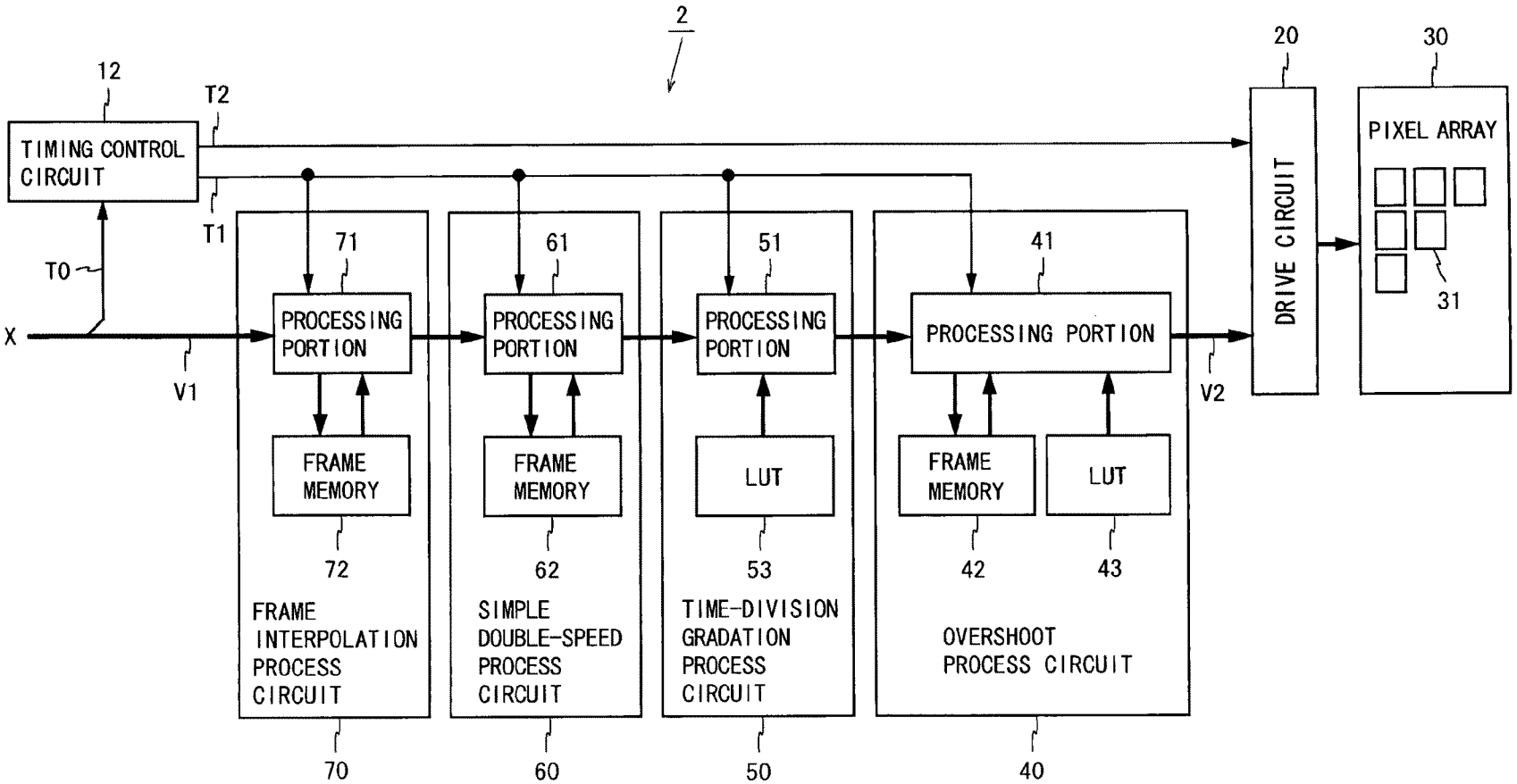
FIG. 12 is a block diagram illustrating the configuration of a liquid crystal display device according to a second embodiment of the present invention.

FIG. 12 is a block diagram illustrating the configuration of a liquid crystal display device according to a second embodiment of the present invention. The liquid crystal display device 2 shown in FIG. 12 includes a timing control circuit 12, a drive circuit 20, a pixel array 30, an overshoot process circuit 40, a time-division gradation process circuit 50, a simple double-speed process circuit 60, and a frame interpolation process circuit 70. The liquid crystal display device 2 performs four processes (a frame interpolation process, a simple double-speed process, a time-division gradation process, and an overshoot process) on a video signal V1, and provides a gradation display using a resultant video signal V2. In the present embodiment, the simple double-speed process circuit 60 and the frame interpolation process circuit 70 constitute a video conversion circuit for obtaining a video signal in units of sub-frames based on a video signal inputted in units of frames. In the present embodiment, the same elements as those in the first embodiment are denoted by the same reference characters, and any descriptions thereof will be omitted.

An input signal X to be supplied to the liquid crystal display device 2 includes the video signal V1 and a synchronization signal T0. The video signal V1 is inputted to the frame interpolation process circuit 70, and the synchronization signal T0 is inputted to the timing control circuit 12. It should be noted that in the liquid crystal display device 2, the video signal V1 has a refresh rate of 50 Hz. Based on the synchronization signal T0, the timing control circuit 12 outputs a synchronization signal T1 to the frame interpolation process circuit 70, the simple double-speed process circuit 60, the time-division gradation process circuit 50, and the overshoot process circuit 40, while outputting a synchronization signal T2 to the drive circuit 20.

The frame interpolation process circuit 70 includes a processing portion 71 and a frame memory 72, and performs an interpolation process on the video signal V1 in units of frames. More specifically, the video signal V1 inputted to the frame interpolation process circuit 70 is written onto the frame memory 72. The processing portion 71 detects a moving image portion from two frames based on the video signal V1 for the current frame and the video signal memorized in the frame memory 72 for the previous frame. Next, the processing portion 71 obtains the position of the moving image portion at a time point between the previous frame and the current frame, and interposes an interpolation frame, which is a frame (motion-compensated frame) in which the moving image portion has been moved to the obtained position, between the previous frame and the subsequent frame. As a result, a video signal outputted from the frame interpolation process circuit 70 has a refresh rate (100 Hz) which is twice the refresh rate of the video signal V1.

Figure 13:
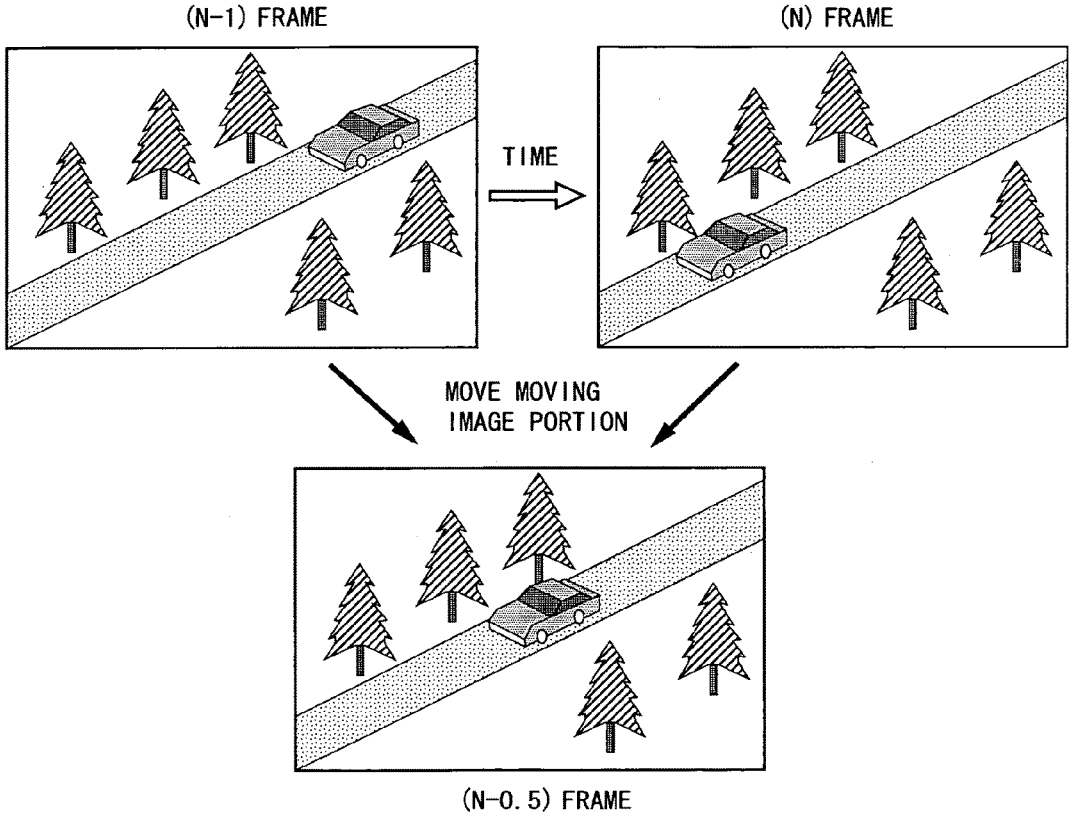
FIG. 13 is a diagram for explaining a frame interpolation process in the liquid crystal display device shown in FIG. 12.

FIG. 13 is a diagram for explaining the frame interpolation process by the frame interpolation process circuit 70. When the video signal V1 includes a series of frames (N−1) and (N), the frame interpolation process circuit 70 performs the following process to create a frame (hereinafter, referred to as a frame (N−0.5)) at a time point between the two frames. The frame interpolation process circuit 70 first detects a moving image portion (in FIG. 13, an image of a car) from the frames (N−1) and (N). The frame interpolation process circuit 70 then obtains the position of the moving image portion in the frame (N−0.5) based on the positions of the moving image portion in the frames (N−1) and (N). Next, the frame interpolation process circuit 70 creates the frame (N−0.5) by moving the moving image portion to the obtained position. The obtained frame (N−0.5) is interposed between the frames (N-1) and (N).

The video signal outputted from the frame interpolation process circuit 70 is inputted to the simple double-speed process circuit 60. As in the first embodiment, the simple double-speed process circuit 60, the time-division gradation process circuit 50, and the overshoot process circuit 40 respectively perform the simple double-speed process, the time-division gradation process, and the overshoot process on the video signal outputted from the frame interpolation process circuit 70.

Figure 14:
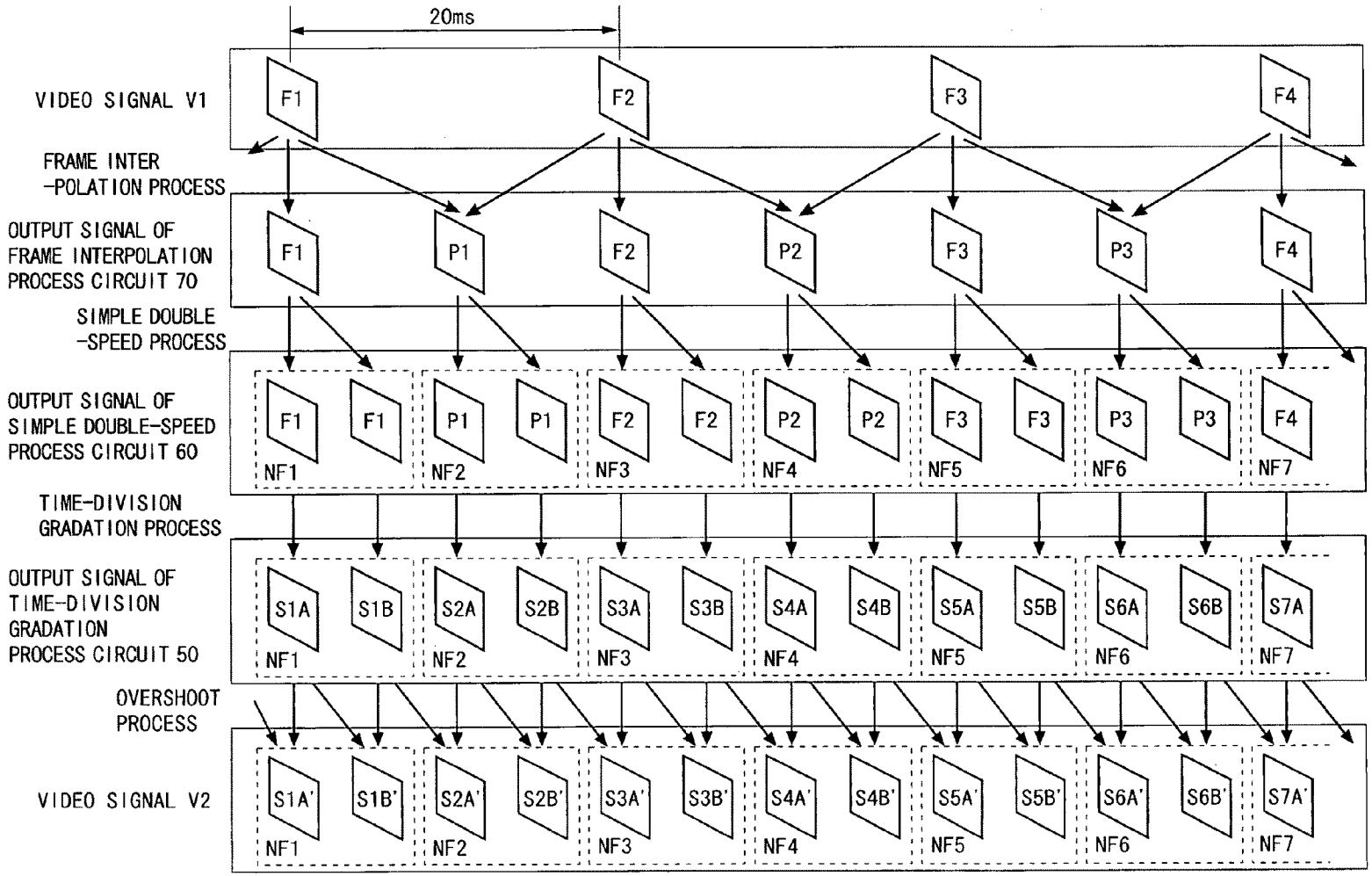
FIG. 14 is a diagram illustrating a frame-by-frame process flow in the liquid crystal display device shown in FIG. 12.

FIG. 14 is a diagram illustrating a frame-by-frame process flow in the liquid crystal display device 2. When the video signal V1 has a refresh rate of 50 Hz, the frame interpolation process circuit 70 receives frames F1, F2, . . . , each being inputted every 20 ms. In the frame interpolation process circuit 70, an interpolation frame P1 is created based on the frames F1 and F2, and interposed between the frames F1 and F2. Similar processing is performed for interpolation frames P2, P3, and so on. As a result, a video signal is obtained having a refresh rate (100 Hz) which is twice the refresh rate of the video signal V1. As in the first embodiment, the video signal outputted from the frame interpolation process circuit 70 is subjected to the simple double-speed process, the time-division gradation process, and the overshoot process.

Figure 15:
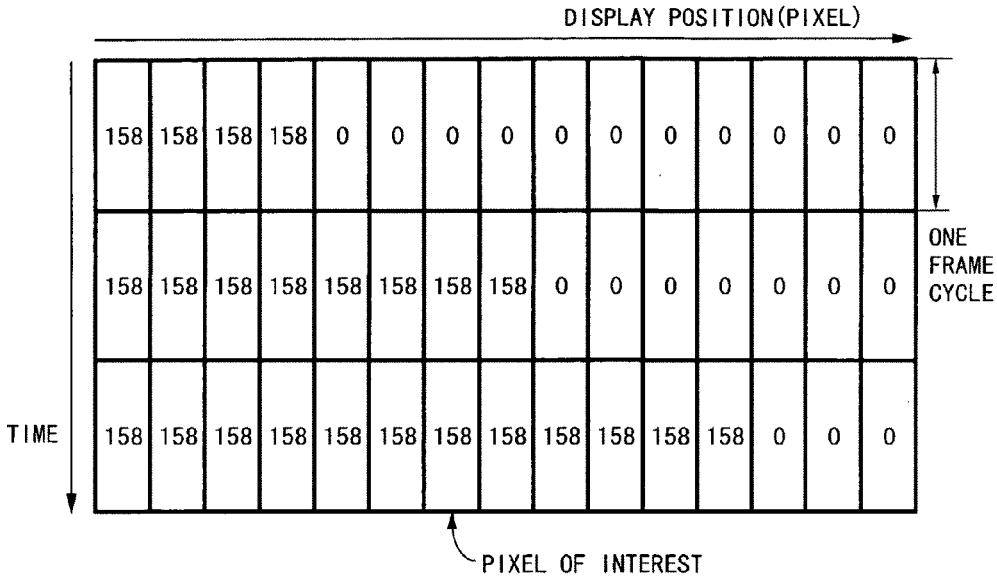
FIG. 15 is a diagram illustrating an exemplary change of a video signal inputted to the liquid crystal display device shown in FIG. 12.
Figure 16:
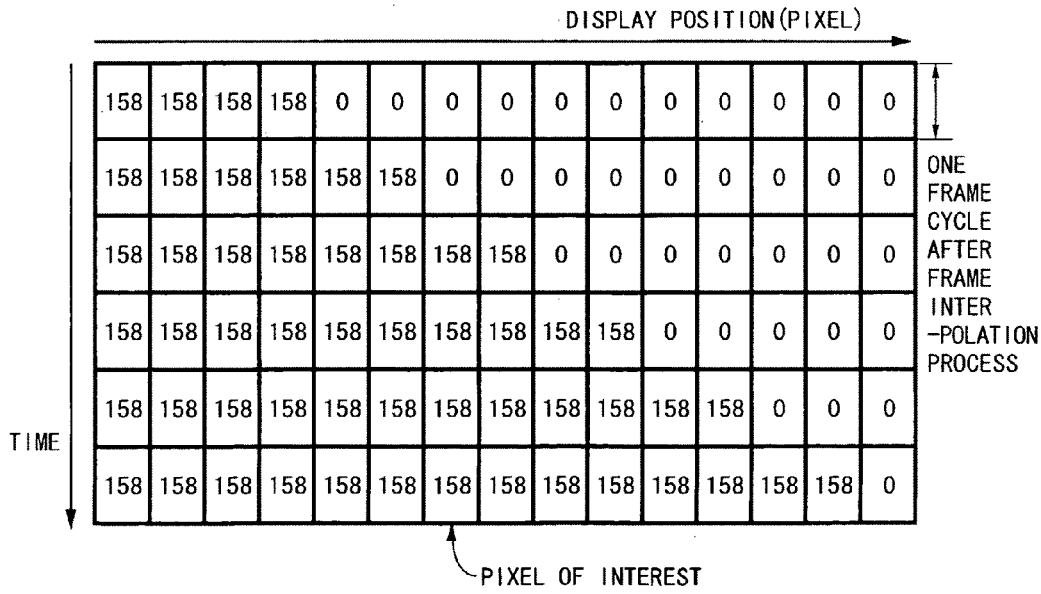
FIG. 16 is a diagram illustrating an exemplary change of an output signal of a frame interpolation process circuit in the liquid crystal display device shown in FIG. 12.

The change in gradation level for each pixel in the liquid crystal display device 2 will be described with respect to the example shown in FIG. 3 as in the first embodiment. FIGS. 15 and 16 are diagrams each illustrating changes over three frame cycles of the video signal V1 and an output signal of the frame interpolation process circuit 70, in relation to pixels in the line of interest. Note that in relation to the pixels in the line of interest, changes over three frame cycles of an output signal of the simple double-speed process circuit 60, an output signal of the time-division gradation process circuit 50, and the video signal V2 are respectively the same as those as shown in FIGS. 5 to 7.

Figure 17:
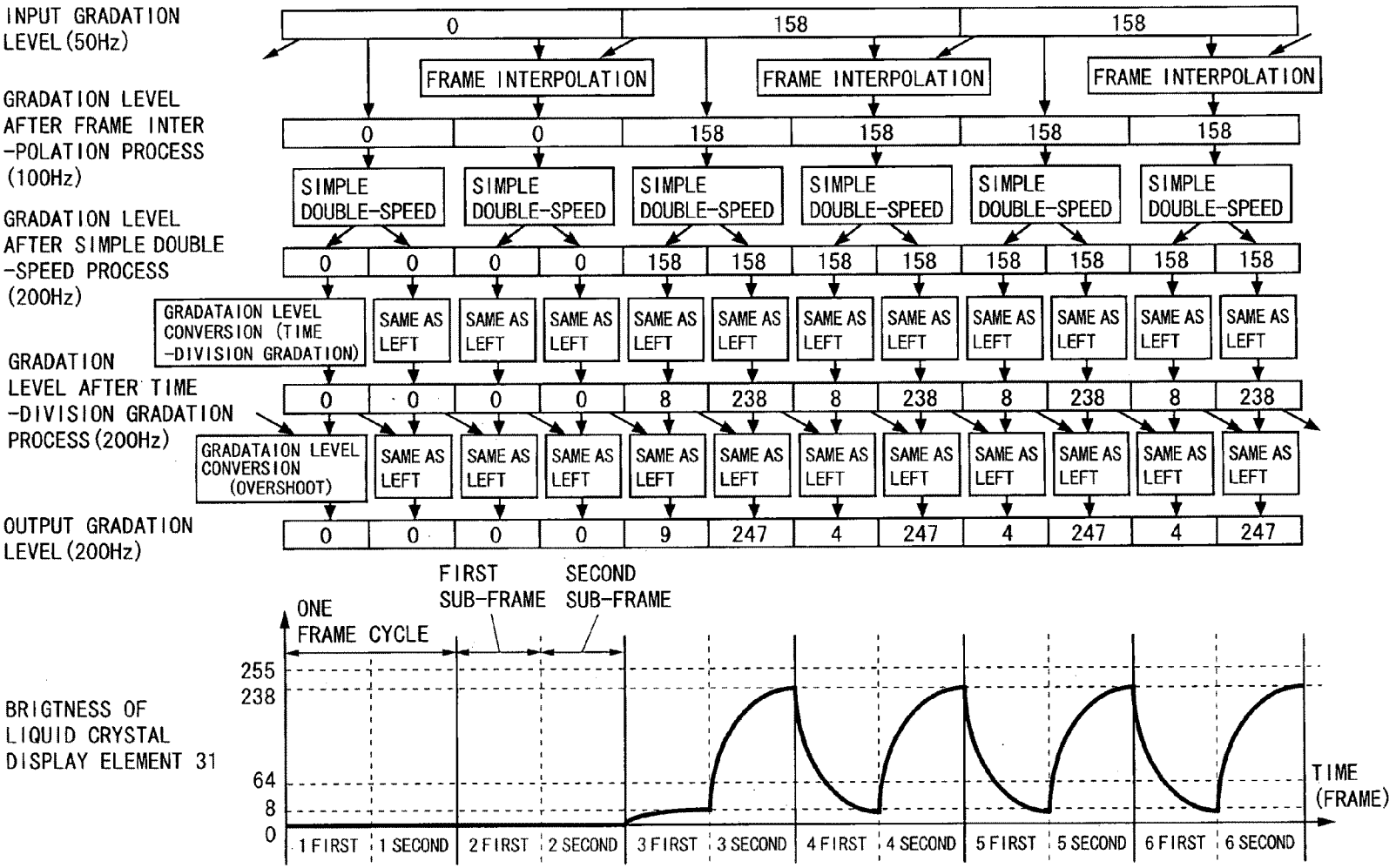
FIG. 17 is a diagram illustrating exemplary changes in gradation level of a video signal and in brightness of a liquid crystal display element, in relation to a pixel in the liquid crystal display device' shown in FIG. 12.

FIG. 17 is a diagram illustrating changes over three frame cycles in gradation level of the video signal and in brightness of the liquid crystal display element 31, in relation to the pixel of interest. It should be noted that in the frame interpolation process by the frame interpolation process circuit 70, for the pixel of interest, the input gradation level for the previous frame is outputted as the gradation level after the frame interpolation process. In this case, when the input gradation level changes at a rate of 50 Hz in the order: 0, 158, 158, and soon, the gradation level after the frame interpolation process changes at a rate of 100 Hz in the order: 0, 0, 158, 158, 158, 158, and so on. Processing after the frame interpolation process is the same as in the first embodiment, and therefore any description thereof will be omitted herein.

When using the time-division gradation process circuit 50 and the overshoot process circuit 40 that have been described in the first embodiment, as shown in FIG. 17, the brightness of the pixel of interest in the liquid crystal display device 2 is 8 during the first sub-frame, and 238 during the second sub-frame in the third and subsequent frames, as in the first embodiment. In addition, pixels around the boundary coincide with other pixels in terms of the minimum brightness during the first sub-frame and the maximum brightness during the second sub-frame. Accordingly, for the same reason as in the first embodiment, it is possible to suppress occurrence of any false contour different from a true contour.

As described above, in the liquid crystal display device 2 according to the present embodiment, the frame interpolation process circuit 70 and the overshoot process circuit 40 at the subsequent stage of the time-division gradation process circuit 50 are provided, and frame interpolation drive, time-division gradation drive, and overshoot drive are performed. Frame interpolation drive and time-division gradation drive make it possible to suppress occurrence of any moving image blur, and overshoot drive makes it possible to make up for a lack of response speed of the liquid crystal display elements 31. Accordingly, the liquid crystal display device 2 makes it possible to improve moving image display performance, while making up for the lack of response speed of the display elements.

Third Embodiment

Figure 18:
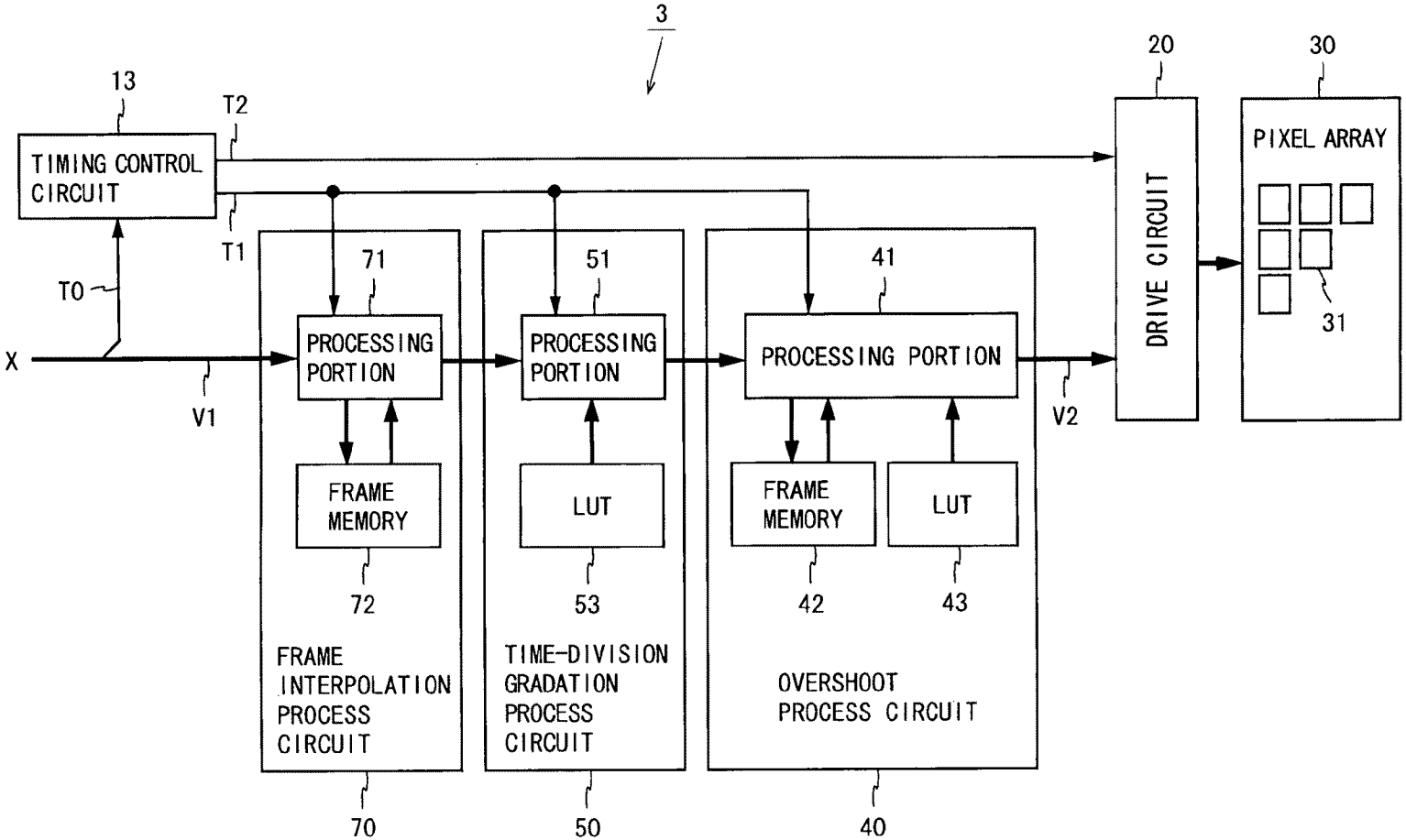
FIG. 18 is a block diagram illustrating the configuration of a liquid crystal display device according to a third embodiment of the present invention.

FIG. 18 is a block diagram illustrating the configuration of a liquid crystal display device according to a third embodiment of the present invention. The liquid crystal display device 3 shown in FIG. 18 includes a timing control circuit 13, a drive circuit 20, a pixel array 30, an overshoot process circuit 40, a time-division gradation process circuit 50, and a frame interpolation process circuit 70. The liquid crystal display device 3 performs three processes (a frame interpolation process, a time-division gradation process, and an overshoot process) on a video signal V1, and displays a screen based on a resultant video signal V2. In the present embodiment, the frame interpolation process circuit 70 constitutes a video conversion circuit for obtaining a video signal in units of sub-frames based on a video signal inputted in units of frames. In the present embodiment, the same elements as those in the above-described embodiments are denoted by the same reference characters, and any descriptions thereof will be omitted.

An input signal X to be supplied to the liquid crystal display device 3 includes the video signal V1 and a synchronization signal T0. The video signal V1 is inputted to the frame interpolation process circuit 70, and the synchronization signal T0 is inputted to the timing control circuit 13. It should be noted that in the liquid crystal display device 3, the video signal V1 has a refresh rate of 60 Hz. Based on the synchronization signal T0, the timing control circuit 13 outputs a synchronization signal T1 to the frame interpolation process circuit 70, the time-division gradation process circuit 50, and the overshoot process circuit 40, while outputting a synchronization signal T2 to the drive circuit 20.

Figure 19:
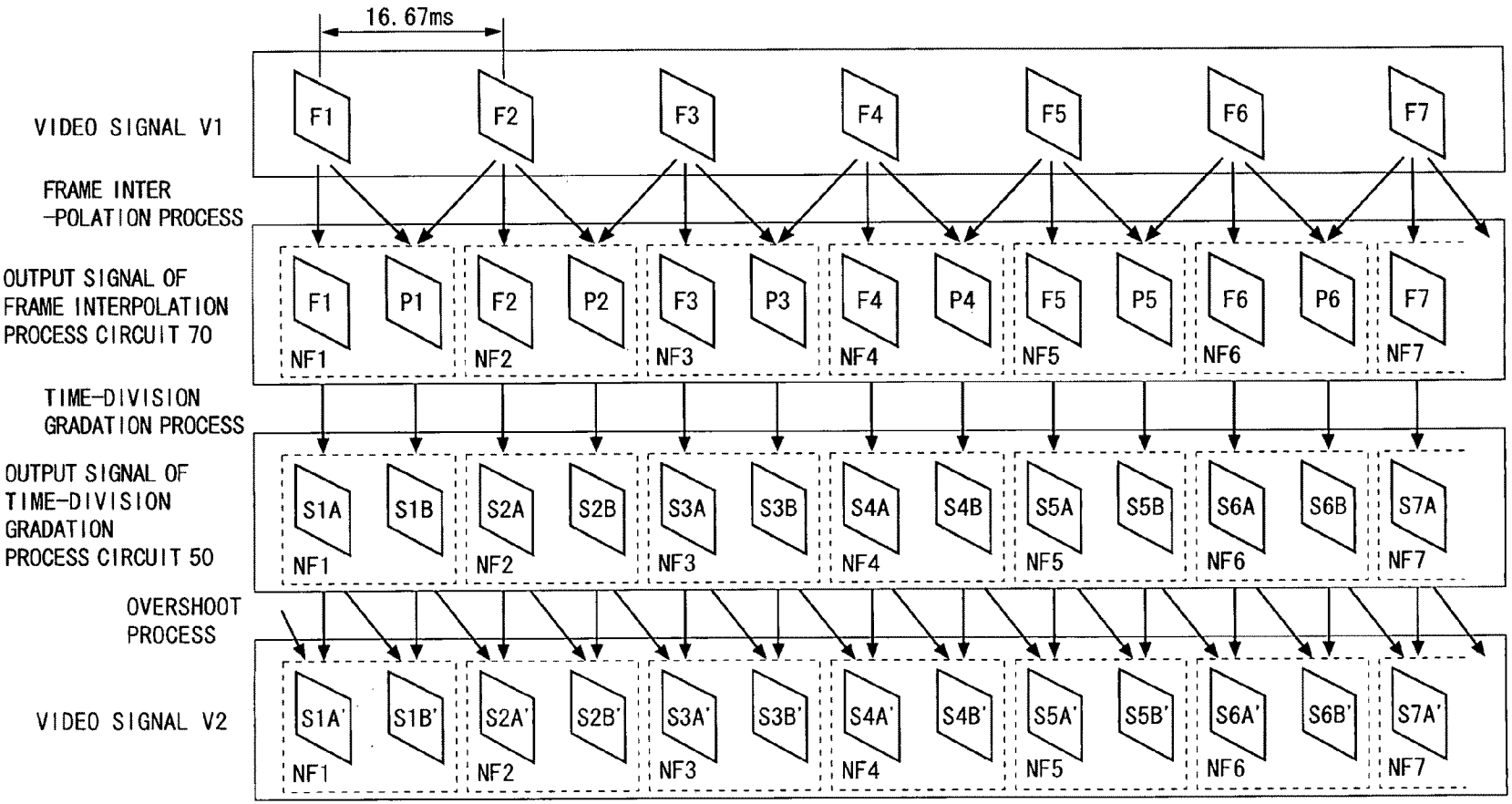
FIG. 19 is a diagram illustrating a frame-by-frame process flow in the liquid crystal display device shown in FIG. 18.

FIG. 19 is a diagram illustrating a frame-by-frame process flow in the liquid crystal display device 3. When the video signal V1 has a refresh rate of 60 Hz, the frame interpolation process circuit 70 receives frames F1, F2, . . . , each being inputted every 16.67 ms. In the frame interpolation process circuit 70, an interpolation frame P1 is created based on the frames F1 and F2, and interposed between the frames F1 and F2. Similar processing is performed for interpolation frames P2, P3, and so on. As a result, a video signal is obtained having a refresh rate (120 Hz) which is twice the refresh rate of the video signal V1. The video signal outputted from the frame interpolation process circuit 70 is subjected to the time-division gradation process and the overshoot process as in the first embodiment.

The change in gradation level for each pixel in the liquid crystal display device 3 will be described with respect to the example shown in FIG. 3 as in the first embodiment. Note that in the present embodiment, the eighth pixel from the left in the line of interest is taken as a pixel of interest. FIGS. 20 to 23 are diagrams each illustrating changes over six frame cycles of the video signal V1, an output signal of the frame interpolation process circuit 70, an output signal of the time-division gradation process circuit 50, and the video signal V2, in relation to pixels in the line of interest.

Figure 24:
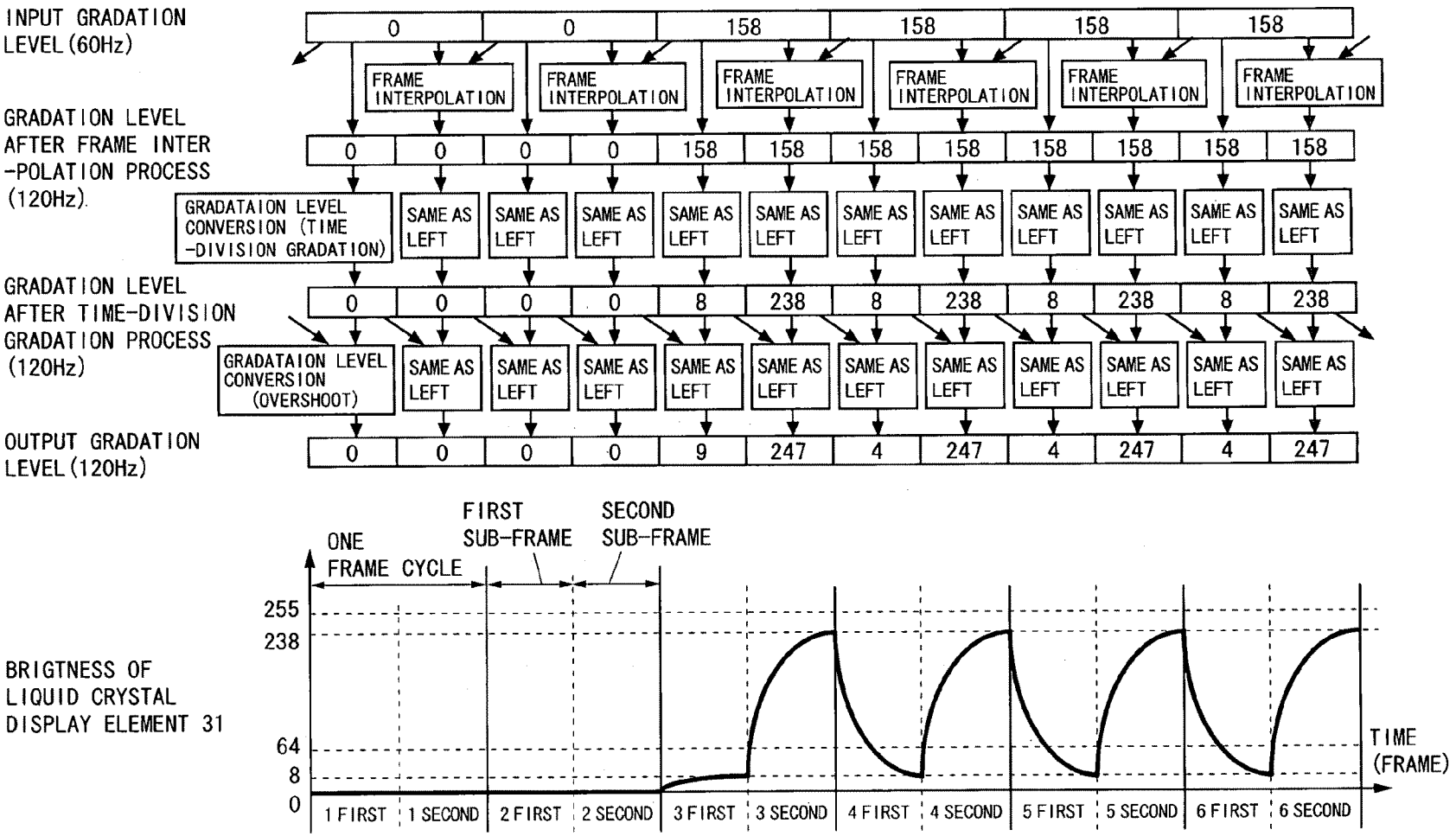
FIG. 24 is a diagram illustrating exemplary changes in gradation level of a video signal and in brightness of a liquid crystal display element, in relation to a pixel in the liquid crystal display device shown in FIG. 18.
Figure 25:
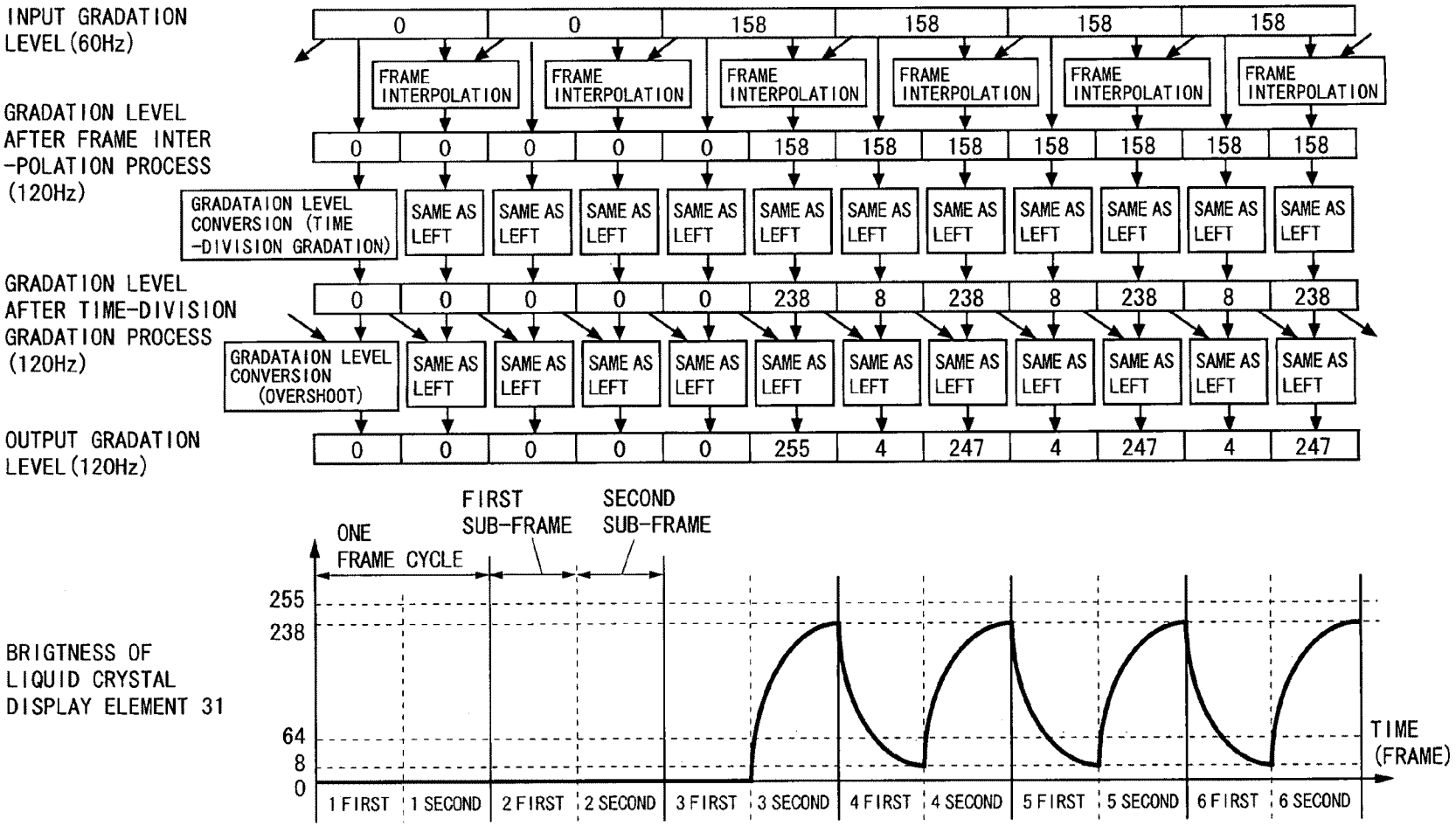
FIG. 25 is a diagram illustrating exemplary changes in gradation level of a video signal and in brightness of a liquid crystal display element, in relation to another pixel in the liquid crystal display device shown in FIG. 18.

FIG. 24 is a diagram illustrating changes over six frame cycles in gradation level of the video signal and in brightness of the liquid crystal display element 31, in relation to the pixel of interest. It should be noted that in the frame interpolation process by the frame interpolation process circuit 70, for the pixel of interest, the input gradation level for the previous frame is outputted as the gradation level after the frame interpolation process. In this case, when the input gradation level changes at a rate of 60 Hz in the order: 0, 0, 158, 158, . . . , the gradation level after the frame interpolation process changes at a rate of 120 Hz in the order: 0, 0, 0, 0, 158, 158, 158, 158, and so on. Processing after the frame interpolation process is the same as in the first embodiment, and therefore any description thereof will be omitted herein. Note that the same contents as in FIG. 24 applied to a pixel to the right of the pixel of interest are shown in FIG. 25.

When using the time-division gradation process circuit 50 and the overshoot process circuit 40 that have been described in the first embodiment, as shown in FIG. 24, the brightness of the pixel of interest in the liquid crystal display device 3 is 8 during the first sub-frame, and 238 during the second sub-frame in the third and subsequent frames, as in the first embodiment. In addition, pixels around the boundary coincide with other pixels in terms of the minimum brightness during the first sub-frame and the maximum brightness during the second sub-frame. Therefore, for the same reason as in the first embodiment, it is possible to suppress occurrence of any false contour different from a true contour.

As described above, in the liquid crystal display device 3 according to the present embodiment, the frame interpolation process circuit 70 and the overshoot process circuit 40 at the subsequent stage of the time-division gradation process circuit 50 are provided, and frame interpolation drive, time-division gradation drive, and overshoot drive are performed. Frame interpolation drive and time-division gradation drive make it possible to suppress occurrence of any moving image blur, and overshoot drive makes it possible to make up for a lack of response speed of the liquid crystal display elements 31. Accordingly, the liquid crystal display device 3 makes it possible to improve moving image display performance, while making up for the lack of response speed of the display elements.

Fourth Embodiment

Figure 26:
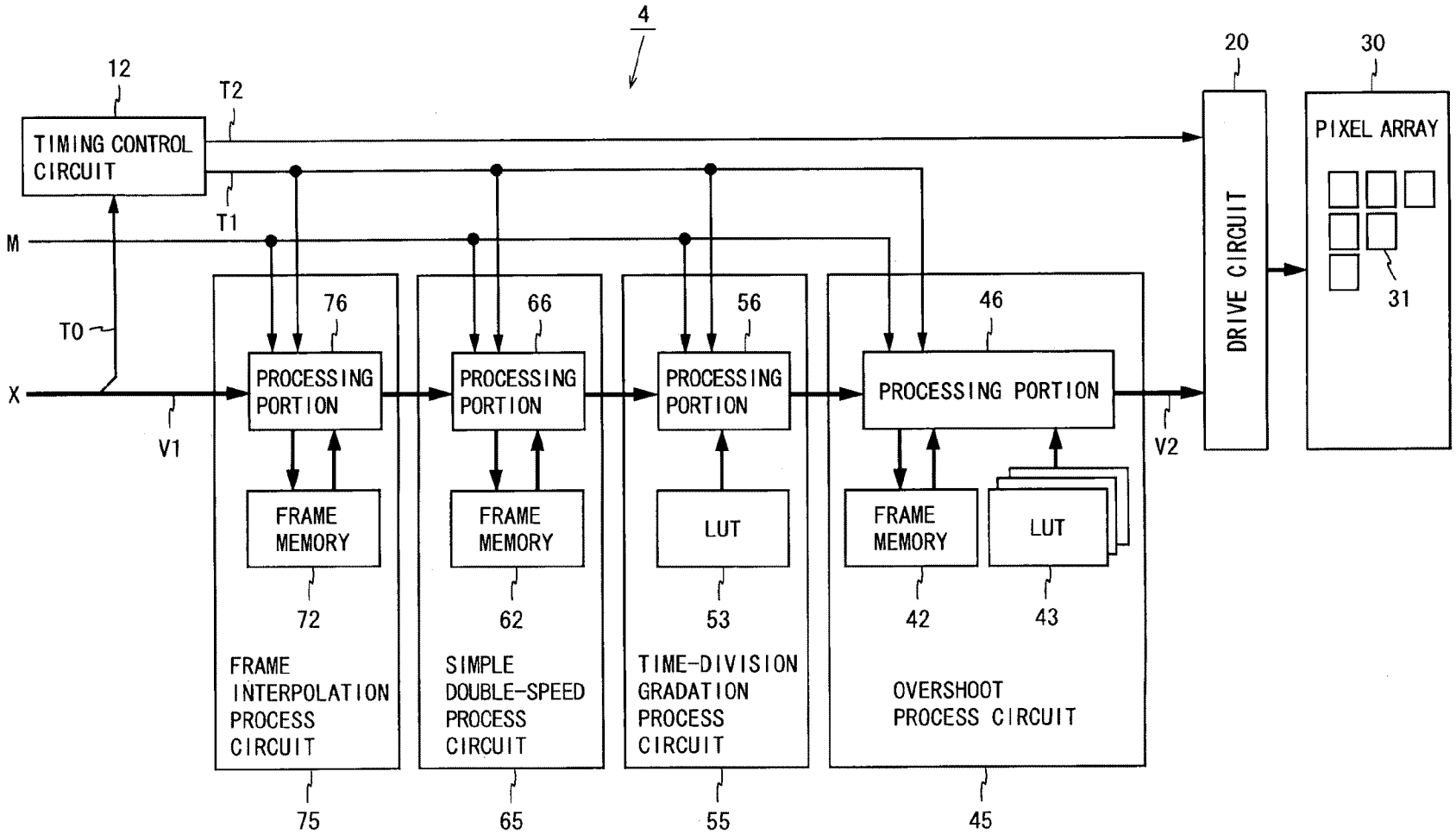
FIG. 26 is a block diagram illustrating the configuration of a liquid crystal display device according to a fourth embodiment of the present invention.
Figure 28:
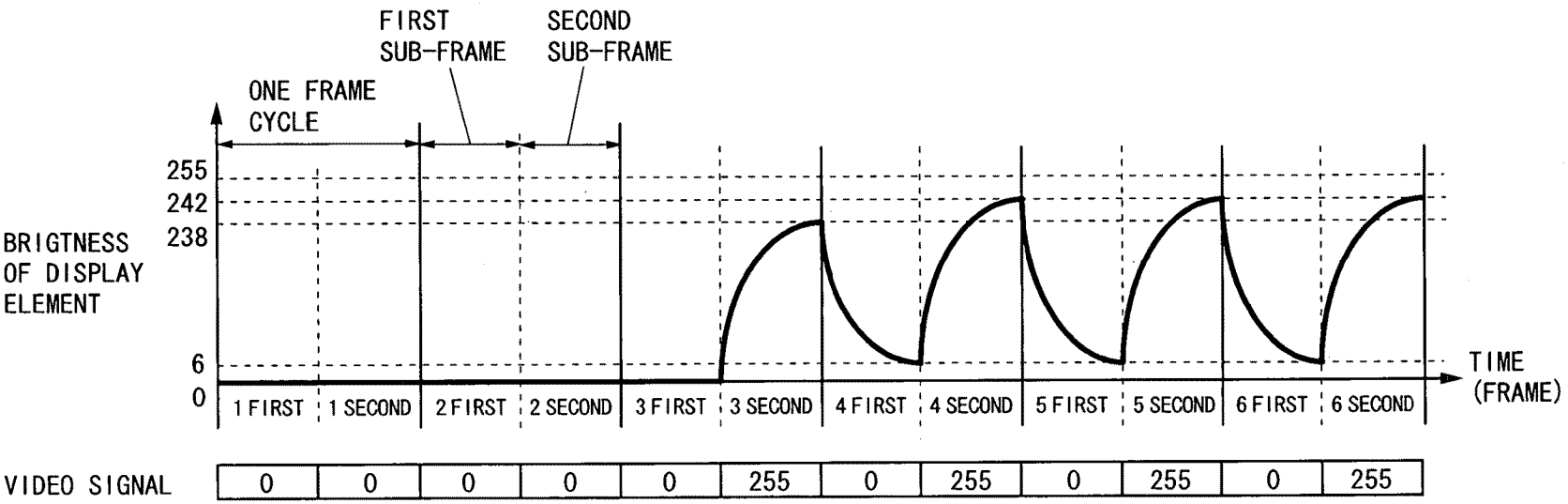
FIG. 28 is a diagram illustrating exemplary changes in gradation level of a video signal provided to a display element and in brightness of the display element in the conventional display device.

FIG. 26 is a block diagram illustrating the configuration of a liquid crystal display device according to a fourth embodiment of the present invention. The liquid crystal display device 4 shown in FIG. 26 includes a timing control circuit 12, a drive circuit 20, a liquid crystal display element 30, an overshoot process circuit 45, a time-division gradation process circuit 55, a simple double-speed process circuit 65, and a frame interpolation process circuit 75. The liquid crystal display device 4 performs selected one or more of three processes (a frame interpolation process, a simple double-speed process, and a time-division gradation process), along with an overshoot process, on a video signal V1, and displays a screen based on a resultant video signal V2. In the present embodiment, the simple double-speed process circuit 65 and the frame interpolation process circuit 75 constitute a video conversion circuit for obtaining a video signal in units of sub-frames based on a video signal inputted in units of frames. In the present embodiment, the same elements as those in the above-described embodiments are denoted by the same reference characters, and any descriptions thereof will be omitted.

The liquid crystal display device 4 is provided with a mode switching signal M, along with an input signal X including the video signal V1 and a synchronization signal T0. The mode switching signal M is a control signal for independently switching between performing and not performing the three processes on the video signal. It should be noted that in the liquid crystal display device 4, the video signal V1 has a refresh rate of 60 Hz.

The frame interpolation process circuit 75 includes a processing portion 76 and a frame memory 72. The processing portion 76 is obtained by providing the processing portion 71 according to the second embodiment with an additional function of switching between performing and not performing the frame interpolation process in accordance with the mode switching signal M. The simple double-speed process circuit 65 includes a processing portion 66 and a frame memory 62. The processing portion 66 is obtained by providing the processing portion 61 according to the first embodiment with an additional function of switching between performing and not performing the simple double-speed process in accordance with the mode switching signal M. The time-division gradation process circuit 55 includes a processing portion 56 and an LUT 53. The processing portion 56 is obtained by providing the processing portion 51 according to the first embodiment with an additional function of switching between performing and not performing the time-division gradation process in accordance with the mode switching signal M. When performing no process on the video signal, the processing portions 56, 66, and 76 output the video signal inputted thereto without modification.

The overshoot process circuit 45 includes a processing portion 46, a frame memory 42, and a plurality of LUTs 43. The processing portion 46 is obtained by providing the processing portion 41 according to the first embodiment with an additional function of selecting an LUT to be used for gradation level conversion from among the LUTs 43, in accordance with the mode switching signal M.

The frame interpolation process circuit 75, the simple double-speed process circuit 65, and the time-division gradation process circuit 55 each switch between processing and not processing the video signal in accordance with the mode switching signal M, and the overshoot process circuit 45 changes the contents of the gradation level conversion in accordance with the mode switching signal M.

For example, when the mode switching signal M takes a first value, the simple double-speed process circuit 65 and the time-division gradation process circuit 55 perform their processes, but the frame interpolation process circuit 75 does not perform its process. In this case, the liquid crystal display device 4 operates in the same manner as the liquid crystal display device 1 according to the first embodiment. In addition, when the mode switching signal M takes a second value, the frame interpolation process circuit 75, the simple double-speed process circuit 65, and the time-division gradation process circuit 55 perform their processes. In this case, the liquid crystal display device 4 operates in the same manner as the liquid crystal display device 2 according to the second embodiment. In addition, when the mode switching signal M takes a third value, the frame interpolation process circuit 75 and the time-division gradation process circuit 55 perform their processes, but the simple double-speed process circuit 65 does not perform its process. In this case, the liquid crystal display device 4 operates in the same manner as the liquid crystal display device 3 according to the third embodiment. In addition, when the mode switching signal M takes a fourth value, the frame interpolation process circuit 75 performs its process, but the simple double-speed process circuit 65 and the time-division gradation process circuit 55 do not perform their processes. In this case, the liquid crystal display device 4 performs frame interpolation drive and overshoot drive.

As described above, the liquid crystal display device 4 according to the present embodiment switches between performing and not performing any of the processes on the video signal, and between changing and not changing the contents of the gradation level conversion in the overshoot process circuit 45, in accordance with a control signal. Accordingly, it is possible to change the mode of driving the display elements based on the control signal. In addition, the overshoot process circuit is provided for performing a different type of gradation level conversion in accordance with the control signal, and therefore it is possible to eliminate the need to provide an overshoot process circuit for each drive mode, resulting in a reduction in the cost of the image display device.

Note that the liquid crystal display devices according to the first to fourth embodiments have been described as including the simple double-speed process circuit and the frame interpolation process circuit for doubling the refresh rate of the video signal, but instead of including them, they may include a simple M-times higher speed process circuit (a predetermined-times higher speed process circuit) for increasing the refresh rate of the video signal by M-fold, and a frame interpolation process circuit for increasing the refresh rate of the video signal by N-fold.

Also, the LUT included in the overshoot drive circuit may have post-conversion gradation levels stored therein in association with all or part of combinations of pre-conversion gradation levels and gradation levels of immediately previous sub-frames, or the overshoot drive circuit may include no LUT. When no post-conversion gradation is stored in the LUT, the processing portion included in the overshoot drive circuit may perform arithmetic operations based on the pre-conversion gradation levels and the gradation levels of the immediately previous sub-frame, thereby obtaining the post-conversion gradation levels.

Also, the frame interpolation process circuit, the simple M-times higher speed process circuit, and the overshoot drive circuit may independently include an individual frame memory, or they may share one frame memory. Moreover, the frame interpolation process circuit may obtain a motion vector based on previous and subsequent frames, and create an interpolation frame based on the obtained motion vector, or it may create an interpolation frame by any other method.

Also, the display mode of the liquid crystal display device may be a VA (vertically aligned) mode, an IPS (in-plane switching) mode, an OCB (optically-compensated birefringence) mode, a TN (twisted nematic) mode, or any other mode. Moreover, electroluminescence elements may be used as display elements to configure an electroluminescence display device.

As with the liquid crystal display devices according to the first to fourth embodiments, these liquid crystal display device and the image display device also make it possible to improve moving image display performance, while making up for a lack of response speed of the display elements.

INDUSTRIAL APPLICABILITY

The image display device of the present invention makes it possible to improve moving image display performance, while making up for a lack of response speed of display elements, and therefore can be used as any of various image display devices, such as a liquid crystal display device or an electroluminescence display device.

The invention claimed is:

1. An image display device for providing a gradation display based on a video signal, comprising:

a plurality of display elements;

a drive circuit for driving the display elements;

a video conversion circuit for obtaining a video signal in units of sub-frames based on a video signal inputted in units of frames;

a time-division gradation process circuit for performing gradation level conversion on a video signal outputted from the video conversion circuit to distribute brightness for one frame cycle to a plurality of sub-frame cycles; and an overshoot process circuit for performing gradation level conversion on a video signal outputted from the time-division gradation process circuit to emphasize a temporal change of the signal, and outputting a resultant video signal to the drive circuit.

2. The image display device according to claim 1, wherein the video conversion circuit includes a predetermined-times higher speed process circuit for outputting the input video signal a plurality of times in units of frames.

3. The image display device according to claim 1, wherein the video conversion circuit includes:

a frame interpolation process circuit for performing an interpolation process on the input video signal in units of frames; and a predetermined-times higher speed process circuit for outputting a video signal outputted from the frame interpolation process circuit a plurality of times in units of frames.

4. The image display device according to claim 1, wherein the video conversion circuit includes a frame interpolation process circuit for performing an interpolation process on the input video signal in units of frames.

5. The image display device according to claim 1, wherein, the video conversion circuit includes one or more video processing circuits for processing the video signal, the video processing circuit and the lime-division gradation process circuit switch between processing and not processing the video signal in accordance with a control signal, and the overshoot process circuit performs a different type of gradation level conversion in accordance with the control signal.

6. The image display device according to claim 1, wherein the overshoot process circuit performs gradation level conversion on a video signal outputted from the time-division gradation process circuit, such that brightness of the display elements after one sub-frame cycle corresponds to a pre-conversion gradation level of the video signal.

7. The image display device according to claim 1, wherein the overshoot process circuit performs the gradation level conversion only when a video signal outputted from the time-division gradation process circuit changes by a predetermined value or more from an immediately previous sub-frame.

8. The image display device according to claim 1, wherein, where maximum reachable brightness value signifies brightness of the display elements after one sub-frame cycle since a gradation level of a video signal provided to the display elements changed from minimum to maximum, and minimum reachable brightness value signifies brightness of the display elements after one sub-frame cycle since the gradation level of the video signal provided to the display elements changed from maximum to minimum, the time-division gradation process circuit outputs a value between the minimum reachable brightness value and the maximum reachable brightness value as a post-conversion gradation level when a gradation level of the video signal outputted from the video conversion circuit is between the minimum reachable brightness value and the maximum reachable brightness value.

9. The image display device according to claim 8, wherein the time-division gradation process circuit outputs a pre-conversion gradation level as the post-conversion gradation level when the gradation level of the video signal outputted from the video conversion circuit is less than the minimum reachable brightness value or greater than the maximum reachable brightness value.

10. The image display device according to claim 1, wherein the display elements have a response speed slower than a speed corresponding to one sub-frame cycle.

11. The image display device according to claim 10, wherein the display elements are liquid crystal display elements.

12. The image display device according to claim 10, wherein the display elements are electroluminescence elements.

* * * * *